US009760056B2

(12) United States Patent
Hashimoto et al.

(10) Patent No.: US 9,760,056 B2
(45) Date of Patent: Sep. 12, 2017

(54) IMAGE FORMING APPARATUS AND DRUM UNIT

(71) Applicant: Brother Kogyo Kabushiki Kaisha, Nagoya-shi, Aichi-ken (JP)

(72) Inventors: Junichi Hashimoto, Toyohashi (JP); Ryuya Yamazaki, Nagoya (JP)

(73) Assignee: Brother Kogyo Kabushiki Kaisha, Nagoya-shi, Aichi-ken (JO)

( * ) Notice: Subject to any disclaimer, the term of this patent is extended or adjusted under 35 U.S.C. 154(b) by 0 days.

(21) Appl. No.: 15/086,149

(22) Filed: Mar. 31, 2016

(65) Prior Publication Data

US 2016/0291529 A1 Oct. 6, 2016

(30) Foreign Application Priority Data

Mar. 31, 2015 (JP) ..... 2015-074254

(51) Int. Cl.

| | |
|---|---|
| ***G03G 21/10*** | (2006.01) |
| ***G03G 21/12*** | (2006.01) |
| ***G03G 21/18*** | (2006.01) |
| *G03G 21/00* | (2006.01) |

(52) U.S. Cl.

CPC ..... *G03G 21/12* (2013.01); *G03G 21/105* (2013.01); *G03G 21/1814* (2013.01); *G03G 21/0005* (2013.01)

(58) Field of Classification Search

CPC ..... G03G 21/1814; G03G 21/1817; G03G 21/1821; G03G 21/105; G03G 21/12

See application file for complete search history.

(56) References Cited

U.S. PATENT DOCUMENTS 5,659,870 A * 8/1997 Takahara ..... G03G 21/105 399/358
8,116,662 B2 2/2012 Ohta
2009/0324284 A1 12/2009 Ohta

FOREIGN PATENT DOCUMENTS

JP 2010-008810 A 1/2010

* cited by examiner

*Primary Examiner* — Sevan A Aydin
(74) *Attorney, Agent, or Firm* — Banner & Witcoff, Ltd.

(57) ABSTRACT

An image forming apparatus includes a main body casing, a waste toner container, and a drum unit configured to move between a first position inside the main body casing and a second position outside the main body casing, the drum unit including a photoconductive drum, a cleaner, and a transporter including a first transportation member, and a transportation tube including a first frame including a first half-tubular section and a tubular section, and a second frame including a second half-tubular section. The first half-tubular section and the second half-tubular section define a first space configured to allow toner removed by the cleaner to pass therethrough. The tubular section of the first frame defines a second space configured to allow the toner passed through the first space to pass therethrough.

20 Claims, 10 Drawing Sheets

IMAGE FORMING APPARATUS AND DRUM UNIT

CROSS-REFERENCE TO RELATED APPLICATION

This application claims priority under 35 U.S.C. §119 from Japanese Patent Application No. 2015-074254 filed on Mar. 31, 2015. The entire subject matter of the application is incorporated herein by reference.

BACKGROUND

Technical Field

The following description relates to one or more aspects of an electrophotographic image forming apparatus and a drum unit attached thereto.

Related Art

As an electrophotographic image forming apparatus, a tandem-type image forming apparatus has been known that includes respective photoconductive drums corresponding to four colors of yellow, magenta, cyan, and black.

As such an image forming apparatus, an image forming apparatus has been proposed that includes a plurality of development units each of which includes a cleaning blade and a first transportation unit, and a second transportation unit. The cleaning blade is configured to support a photoconductive drum and remove toner remaining on the photoconductive drum. The first transportation unit is configured to transport the remaining toner removed by the cleaning blade. The second transportation unit is configured to transport the remaining toner passed through the first transportation unit, to a waste toner container.

SUMMARY

In the proposed image forming apparatus, the second transportation unit collectively transports the remaining toner from the plurality of development units, and therefore includes a long pipe member.

Since it is difficult to form the long pipe member from a single component, it is considered to form the long pipe member from a plurality of components. Nonetheless, in such a case, as toner is transported more downstream in a transportation direction, a higher toner pressure is applied to the pipe member. In particular, at a downstream portion of the pipe member in the transportation direction, due to a high toner pressure, a gap might be easily formed between the plurality of components. Thus, toner might be likely to easily leak from the gap.

Aspects of the present disclosure are advantageous to provide one or more improved techniques, for an image forming apparatus, which make it possible to stably transport toner.

According to aspects of the present disclosure, an image forming apparatus is provided, which includes a main body casing, a waste toner container, and a drum unit configured to move between a first position inside the main body casing and a second position outside the main body casing, the drum unit including a photoconductive drum, a cleaner configured to remove toner remaining on a surface of the photoconductive drum, and a transporter configured to transport the toner removed by the cleaner toward the waste toner container, the transporter including a first transportation member configured to transport the toner removed by the cleaner, in a transportation direction along a moving direction of the drum unit, and a transportation tube accommodating the first transportation member, the transportation tube having an exhaust port configured to allow the toner transported by the first transportation member to pass therethrough toward the waste toner container, the transportation tube including a first frame including a first half-tubular section and a tubular section, and a second frame including a second half-tubular section, the first half-tubular section and the second half-tubular section being configured to define a first space as a hollow space, the first space being configured to allow the toner removed by the cleaner to pass therethrough, the tubular section of the first frame being configured to define a second space as a hollow space, the second space being configured to allow the toner passed through the first space to pass therethrough.

According to aspects of the present disclosure, further provided is a drum unit including a photoconductive drum, a cleaner configured to remove toner remaining on a surface of the photoconductive drum, and a transporter configured to transport the toner removed by the cleaner, the transporter including a transportation member configured to transport the toner removed by the cleaner, and a transportation tube accommodating the transportation member, the transportation tube having an exhaust port configured to allow the toner transported by the transportation member to pass therethrough, the transportation tube including a first frame including a first half-tubular section and a tubular section, and a second frame including a second half-tubular section, the first half-tubular section and the second half-tubular section being configured to define a first space as a hollow space, the first space being configured to allow the toner removed by the cleaner to pass therethrough, the tubular section of the first frame being configured to define a second space as a hollow space, the second space being configured to allow the toner passed through the first space to pass therethrough.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, illustrative embodiments according to aspects of the present disclosure will be described with reference to the accompanying drawings.

1. Overall Configuration of Image Forming Apparatus

Figure 1:
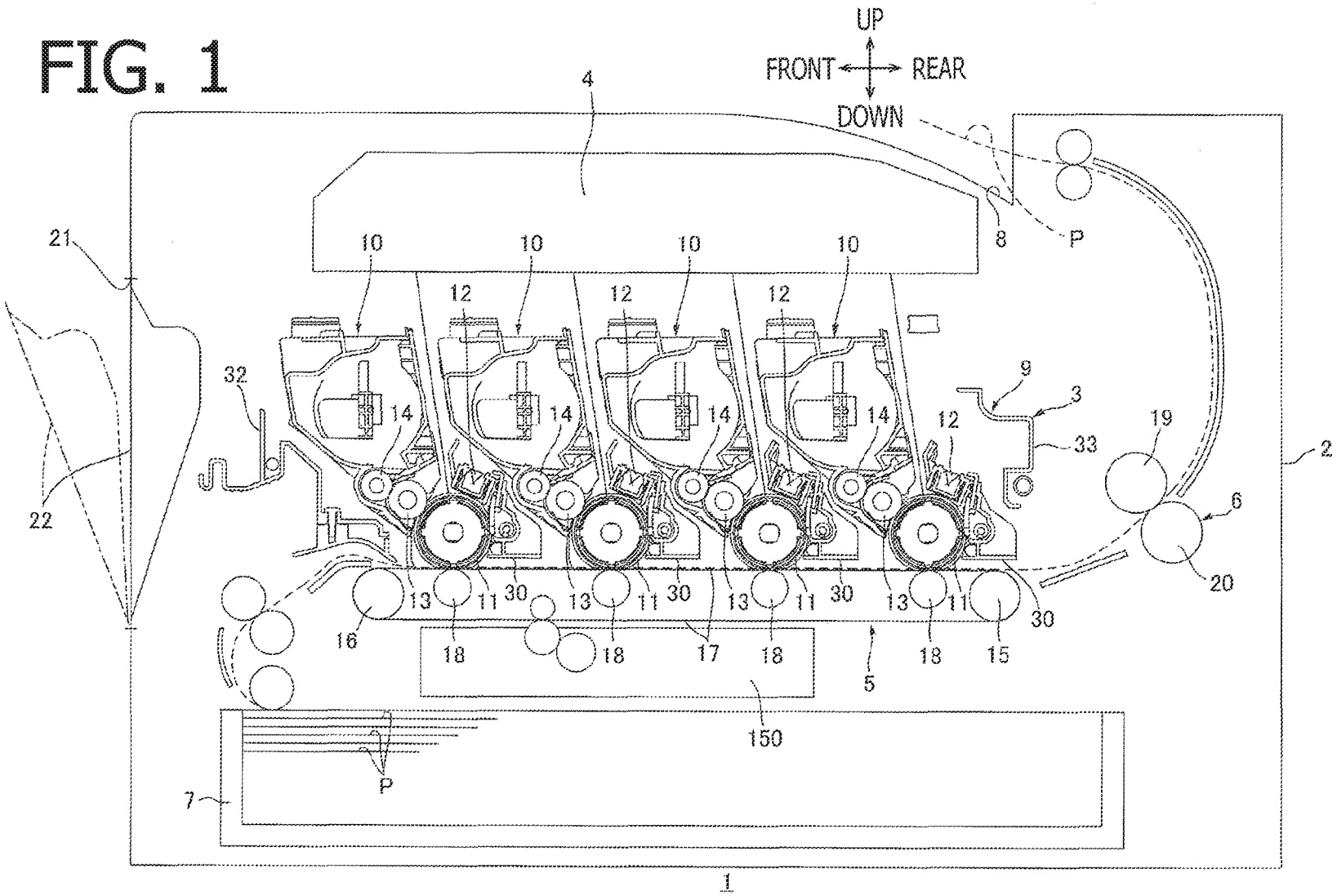
FIG. 1 is a cross-sectional side view of an image forming apparatus in a first illustrative embodiment according to one or more aspects of the present disclosure.

As shown in FIG. 1, an image forming apparatus 1 is a horizontally-laid-type direct tandem color laser printer.

The image forming apparatus 1 includes a main body casing 2, a process unit 3, a scanner unit 4, a belt unit 5, and a fuser unit 6. The main body casing 2 has an opening 21.

The main body casing 2 is formed substantially in a box shape. The main body casing 2 includes a front cover 22, a feed tray 7, and a discharge tray 8.

The opening 21 is formed at a front end portion of the main body casing 2 in such a manner that an inside and an outside of the main body casing 2 communicate with each other via the opening 21 in a front-to-rear direction. Thus, the opening 21 allows the process unit 3 to pass therethrough.

The front cover 22 is disposed at the front end portion of the main body casing 2. The front cover 22 is formed substantially in a flat plate shape. The front cover 22 extends along a vertical direction. The front cover 22 is swingably supported by a front wall of the main body casing 2, with a lower end portion of the front cover 22 as a fulcrum. The front cover 22 is configured to open and close the opening 21.

The feed tray 7 is disposed at a bottom portion of the main body casing 2. The feed tray 7 accommodates sheets P.

The discharge tray 8 is disposed at an upper wall of the main body casing 2. The discharge tray 8 is recessed downward from an upper surface of the main body casing 2. The discharge tray 8 is configured to receive and support sheets P discharged thereon.

The process unit 3 is disposed at a middle portion of the main body casing 2. The process unit 3 is configured to slide along the front-to-rear direction between an inside position and an outside position. The inside position is a position inside the main body casing 2. The outside position is a position outside the main body casing 2. The process unit 3 includes a drum unit 9 and a plurality of development cartridges (in the illustrative embodiment, four development cartridges) 10.

The drum unit 9 includes a plurality of photoconductive drums (in the illustrative embodiment, four photoconductive drums) 11. Further, the drum unit 9 includes a plurality of scorotron chargers (in the illustrative embodiment, four scorotron chargers) 12.

Each photoconductive drum 11 is rotatably supported at a lower end portion of the process unit 3. The four photoconductive drums 11 correspond to yellow, magenta, cyan, and black, respectively. The four photoconductive drums 11 are arranged at intervals in an order of yellow, magenta, cyan, and black from the front to the rear, in parallel with each other. Each photoconductive drum 11 is formed substantially in a cylindrical shape extending along a left-to-right direction.

Each scorotron charger 12 is disposed apart from the corresponding photoconductive drum 11, on an upper rear side relative to the corresponding photoconductive drum 11.

The four development cartridges 10 have the same configuration, except for the colors of toner stored therein. Each development cartridge 10 is disposed above the corresponding photoconductive drum 11. Each development cartridges 10 includes a development roller 13 and a supply roller 14.

Each development roller 13 is rotatably supported to be exposed rearward, at a lower end portion of the corresponding development cartridge 10. Each development roller 13 is disposed to contact an upper end portion of the corresponding photoconductive drum 11.

Each supply roller 14 is disposed on an upper front side relative to the corresponding development roller 13. Further, each supply roller 14 is disposed to contact an upper front end portion of the corresponding development roller 13.

The scanner unit 4 is disposed at an upper end portion of the main body casing 2. As indicated by a solid line in FIG. 1, the scanner unit 4 emits a laser beam toward the photoconductive drums 11 and exposes the photoconductive drums 11, based on image data.

The belt unit 5 is disposed below the process unit 3. The belt unit 5 includes a driving roller 15, a driven roller 16, a belt 17, and a plurality of transfer rollers (in the illustrative embodiment, four transfer rollers) 18.

The driving roller 15 is disposed at a rear end portion of the belt unit 5.

The driven roller 16 is disposed in front of the driving roller 15, to be spaced apart from and opposed to the driving roller 15 in the front-to-rear direction. Further, the driven roller 16 is disposed at a front end portion of the belt unit 5.

The belt 17 is wound around a pair of the driving roller 15 and the driven roller 16 such that an upper portion of the belt 17 contacts all of the photoconductive drums 11 when the drum unit 9 is located in a second inside position within the inside position. The belt 17 is configured to turn in such a manner that the upper portion of the belt 17 moves from the front to the rear in conjunction with rotations of the driving roller 15 and the driven roller 16.

Each transfer roller 18 is disposed to face the corresponding photoconductive drum 11 across the upper portion of the belt 17, below the corresponding photoconductive drum 11.

The fuser unit 6 is disposed behind (i.e., on a rear side relative to) the belt unit 5. The fuser unit 6 includes a heating roller 19 and a pressing roller 20. The pressing roller 20 is configured to contact the heating roller 19.

When the image forming apparatus 1 begins an image forming operation, a scorotron charger 12 evenly charges a surface of the corresponding photoconductive drum 11. Thereafter, the scanner unit 4 exposes the surface of the photoconductive drum 11. Thereby, an electrostatic latent image based on the image data is formed on the surface of the photoconductive drum 11.

Further, the supply roller 14 supplies the development roller 13 with toner in the development cartridge 10. At this time, the toner is positively charged by friction between the development roller 13 and the supply roller 14, and is carried on the development roller 13.

Then, the development roller 13 supplies the toner carried thereon to the electrostatic latent image formed on the surface of the photoconductive drum 11. Thereby, a toner image is carried on the surface of the photoconductive drum 11.

After being fed from the feed tray 7 toward an upper front side by rotations of rollers, sheets P are turned around toward an upper rear side, and are fed between the belt 17 and the photoconductive drum 11 for yellow on a sheet-by-sheet basis at predetermined timings. Thereafter, the sheets P are conveyed from the front to the rear by the belt 17. Each of the toner images is transferred onto a sheet P when the sheet P passes between the corresponding photoconductive drum 11 and the corresponding transfer roller 18.

After that, the sheet P is heated and pressed when passing between the heating roller 19 and the pressing roller 20. At this time, the toner images on the sheet P are thermally fixed onto the sheet P. Afterwards, the sheet P is discharged onto the discharge tray 8.

2. Details about Drum Unit

Figure 2:
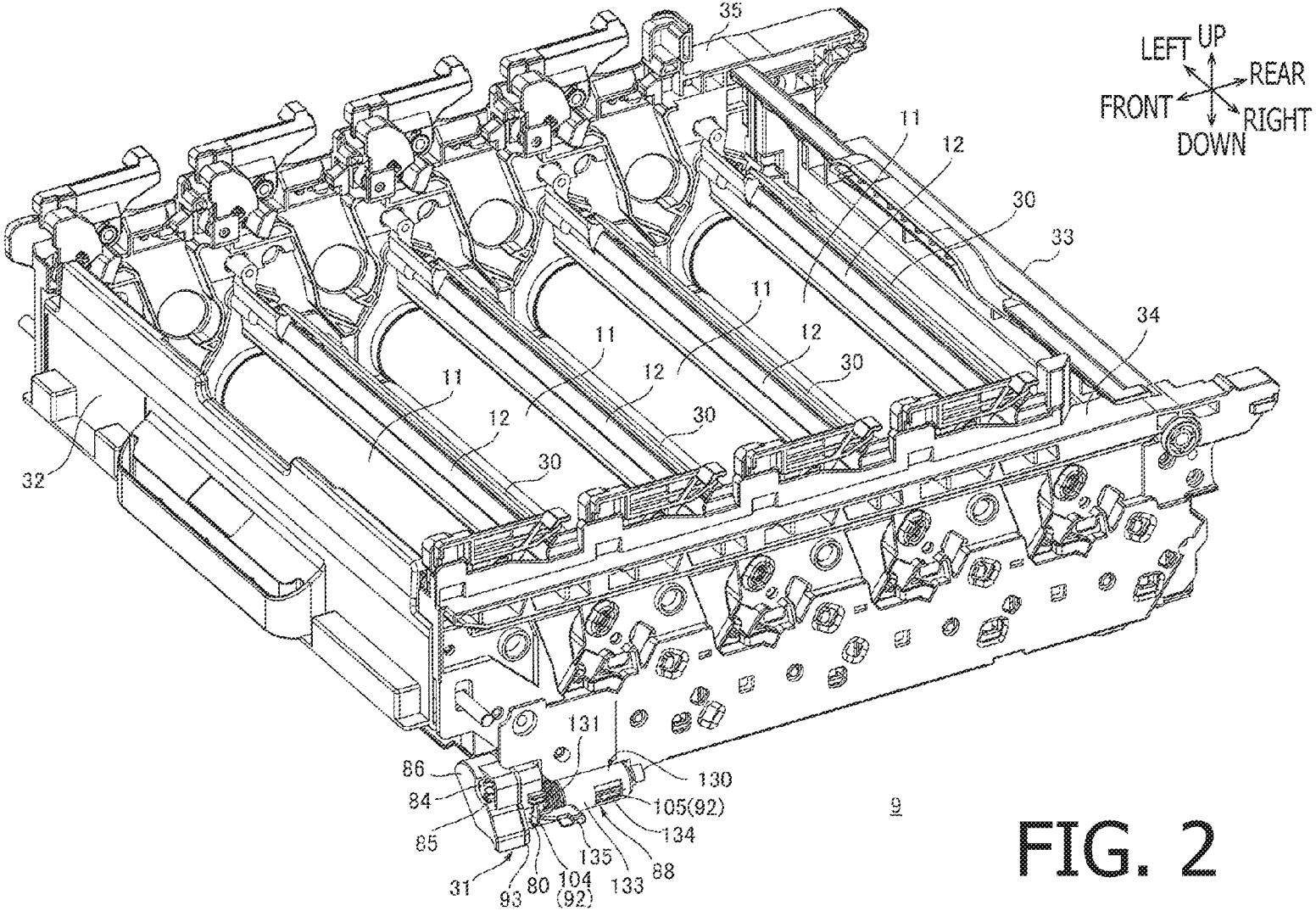
FIG. 2 is a perspective view, from an upper right side, of a drum unit of the image forming apparatus in the first illustrative embodiment according to one or more aspects of the present disclosure.
Figure 4:
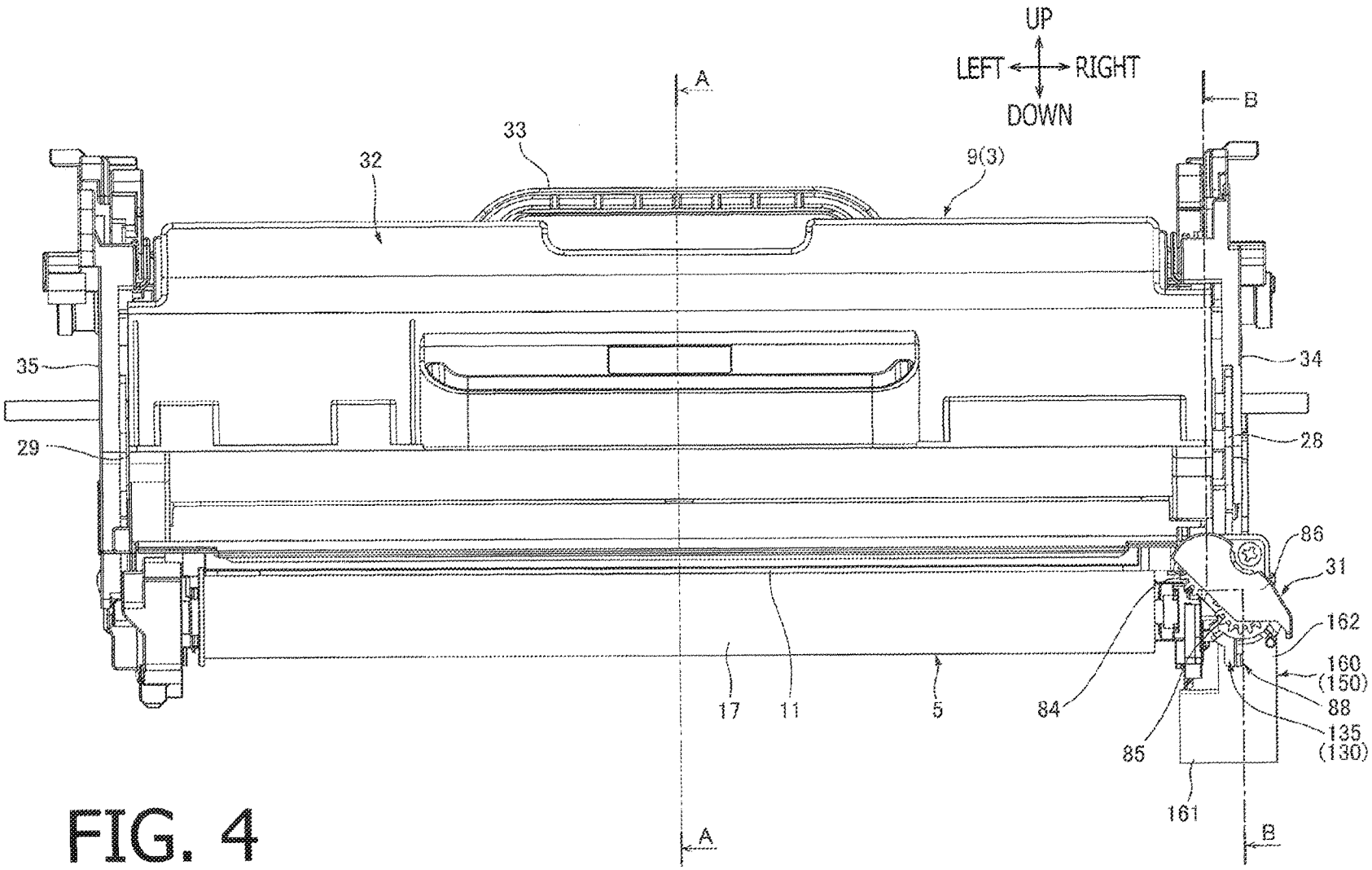
FIG. 4 is a front view of a belt unit of the image forming apparatus in the first illustrative embodiment according to one or more aspects of the present disclosure.

As shown in FIGS. 2 and 4, the drum unit 9 is formed substantially in a rectangular frame shape in a plane view (i.e., when viewed from the top). The drum unit 9 includes a first positioning plate 28, a second positioning plate 29, a plurality of cleaners (in the illustrative embodiment, four cleaners) 30, a transporter 31, a front plate 32, a rear plate 33, a first side plate 34, and a second side plate 35. Each of the first and second positioning plates 28 and 29 includes a plurality of holes (in the illustrative embodiment, four holes) 40 and a plurality of holes (in the illustrative embodiment, four holes) 41.

(1) First Positioning Plate and Second Positioning Plate

Figure 3B:
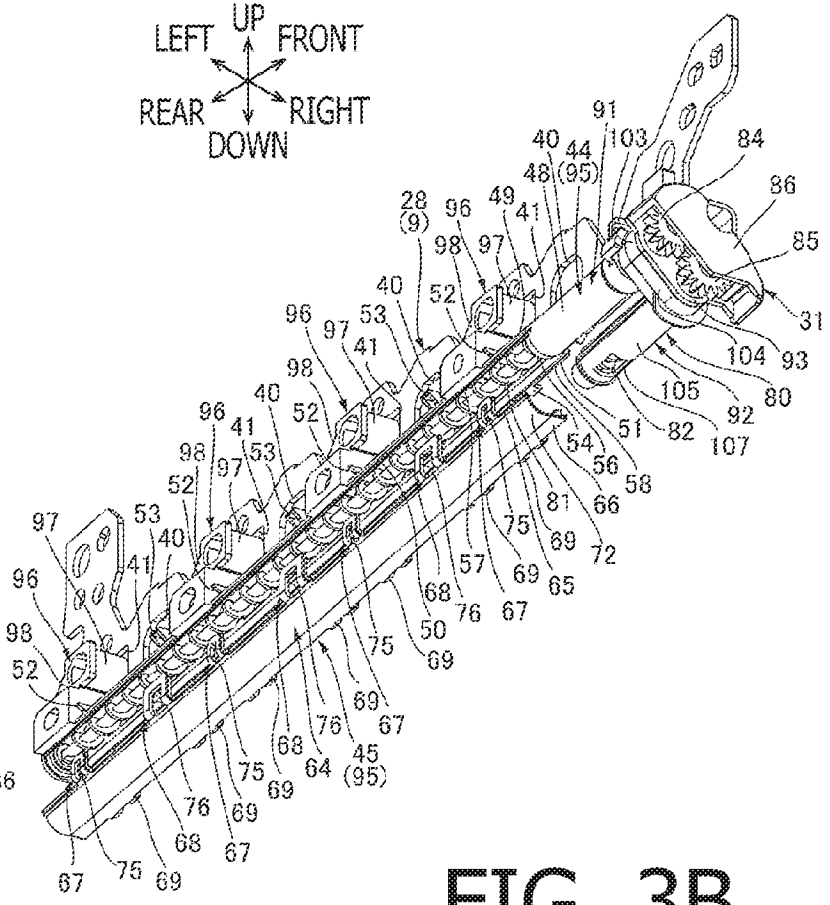
FIG. 3B is an exploded perspective view, from a lower left side, of the transporter with the first positioning plate attached thereto, in the first illustrative embodiment according to one or more aspects of the present disclosure.
Figure 3A:
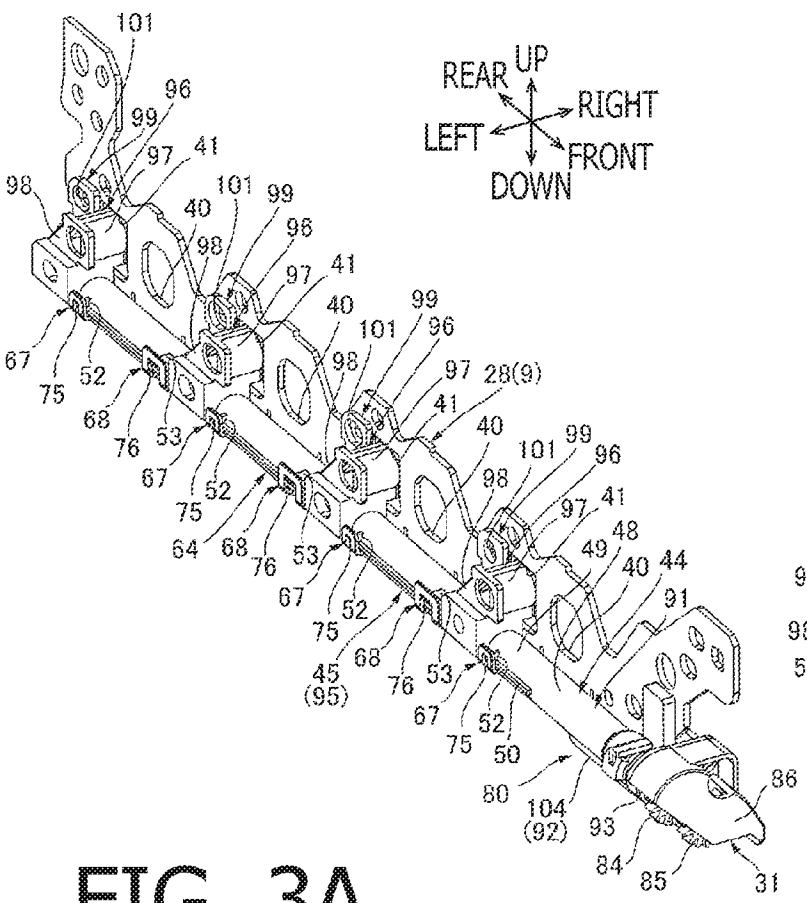
FIG. 3A is a perspective view, from an upper left side, of a transporter with a first positioning plate attached thereto, in the first illustrative embodiment according to one or more aspects of the present disclosure.

As shown in FIG. 4, the first positioning plate 28 is disposed at a right end portion of the drum unit 9. As shown in FIGS. 3A and 3B, the first positioning plate 28 is formed substantially in a rectangular flat plate shape extending along the front-to-rear direction as a longitudinal direction thereof, in a side view (i.e., when viewed along the left-to-right direction).

The four holes 40 are arranged at regular intervals in the front-to-rear direction. Each hole 40 is disposed to be positionally coincident with the corresponding photoconductive drum 11. Each hole 40 is formed substantially in a round shape in a side view (i.e., when viewed along the left-to-right direction).

The four holes 41 are arranged at regular intervals in the front-to-rear direction. Each hole 41 is disposed behind (i.e., on a rear side relative to) the corresponding hole 40. Each hole 41 is formed substantially in a rectangular shape in a side view (i.e., when viewed along the left-to-right direction).

Figure 5:
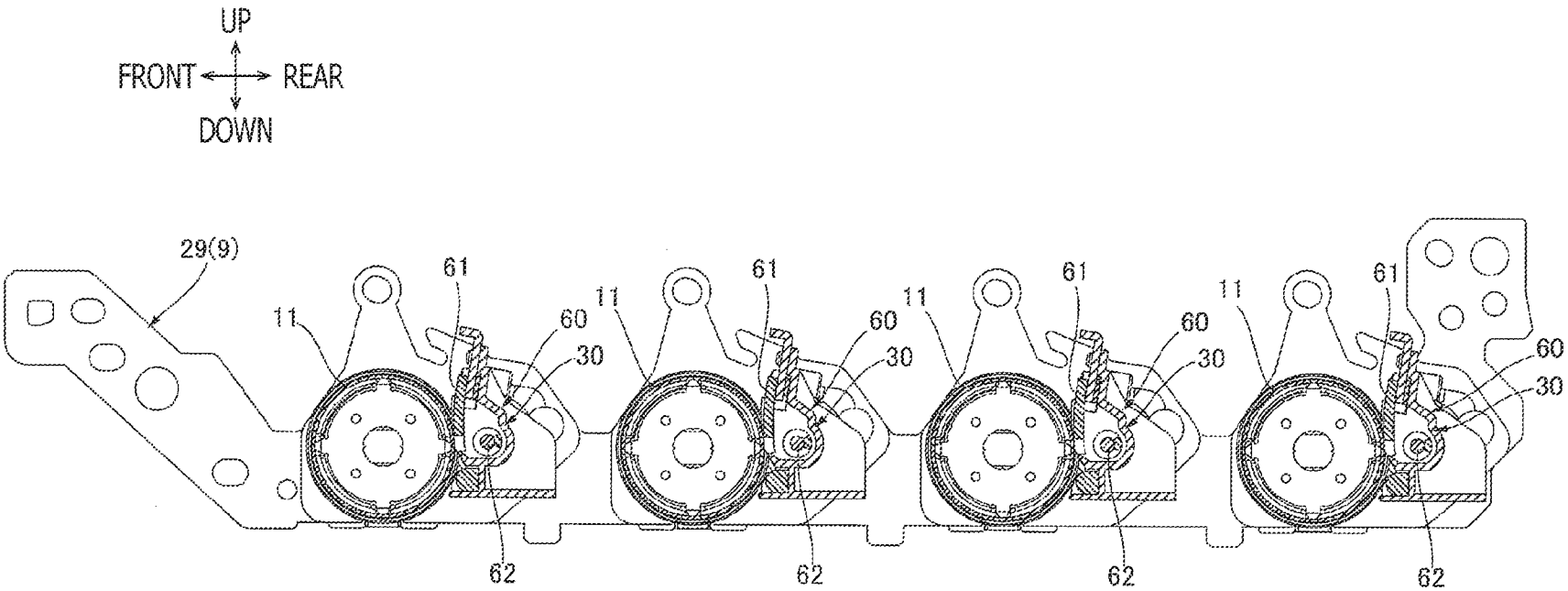
FIG. 5 is a cross-sectional view taken along line A-A shown in FIG. 4, without elements shown other than photoconductive drums, cleaners, and a second positioning plate, in the first illustrative embodiment according to one or more aspects of the present disclosure.

As shown in FIGS. 4 and 5, the second positioning plate 29 is spaced apart leftward from the first positioning plate 28, and is disposed at a left end portion of the drum unit 9. As shown in FIG. 5, the second positioning plate 29 is formed substantially in the same shape as the first positioning plate 28. Therefore, a detailed explanation about the second positioning plate 29 will be omitted.

Then, when each hole 40 of the first positioning plate 28 accepts a right end portion of the corresponding photoconductive drum 11, and each hole 40 of the second positioning plate 29 accepts a left end portion of the corresponding photoconductive drum 11, each photoconductive drum 11 is rotatably supported by and positioned relative to the first and second positioning plates 28 and 29.

(2) Cleaner

As shown in FIGS. 2 and 5, each cleaner 30 is disposed behind (i.e., on a rear side relative to) the corresponding photoconductive drum 11. Each cleaner 30 is configured to remove toner left adhering onto the surface of the photoconductive drum 11. As shown in FIG. 5, each cleaner 30 includes a frame 60, a cleaning member 61, and a cleaning transportation member 62.

The frame 60 is formed substantially in a semi-cylindrical shape extending along the left-to-right direction and having a closed left end portion, an open right end portion, and an open front end portion.

The cleaning member 61 is formed substantially in a flat plate shape extending along the left-to-right direction. An upper end portion of the cleaning member 61 is fixedly attached to an upper end portion of the frame 60. A lower end portion of the cleaning member 61 is opposed to a front portion of the frame 60 so as to cover an upper half of an open part of the front portion of the frame 60. Further, the lower end portion of the cleaning member 61 is bent rearward and in contact with a rear end portion of the corresponding photoconductive drum 11.

The cleaning transportation member 62 is disposed inside the frame 60. The cleaning transportation member 62 is an auger screw having the shape of a right-hand screw extending along the left-to-right direction. A left end portion of the cleaning transportation member 62 is supported by a left wall of the frame 60 to be rotatable relative to the left wall.

(3) Transporter

Figure 6:
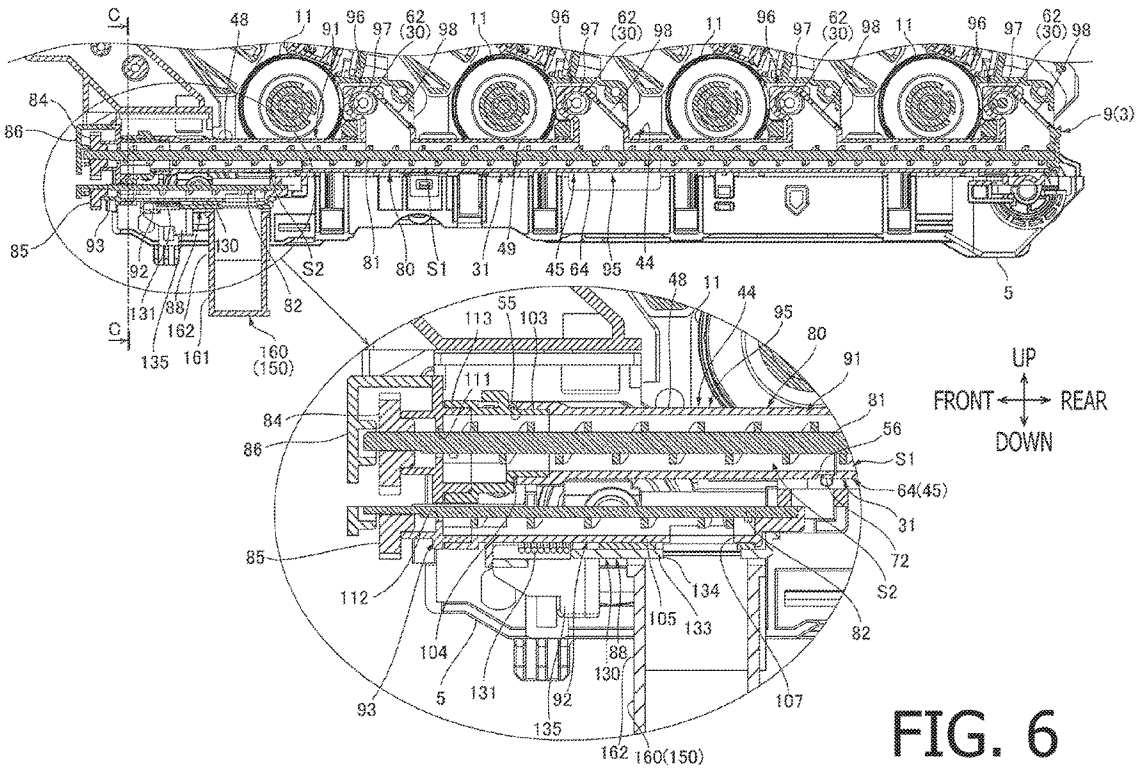
FIG. 6 is a cross-sectional view taken along line B-B shown in FIG. 4, in the first illustrative embodiment according to one or more aspects of the present disclosure.

As shown in FIGS. 2 and 4, the transporter 31 is disposed at a lower right end portion of the drum unit 9. The transporter 31 is configured to transport toner removed from the surfaces of the photoconductive drums 11 by the cleaners 30, to a below-mentioned waste toner container 150. As shown in FIGS. 3B and 6, the transporter 31 includes a transportation tube 80, a first transportation member 81, a second transportation member 82, a first gear 84, a second gear 85, a gear cover 86, and a shutter unit 88.

The transportation tube 80 extends along the front-to-rear direction, i.e., along the moving direction of the drum unit 9. The transportation tube 80 includes a first transportation section 91, a second transportation section 92, and a closed section 93. The closed section 93 has a hole 111 and a hole 112. The hole 111 is a hole through which the first transportation member 81 is inserted. The hole 112 is a hole through which the second transportation member 82 is inserted.

The first transportation section 91 includes a first transportation tube 95 and a plurality of joints (in the illustrative embodiment, four joints) 96.

As shown in FIGS. 3A and 3B, the first transportation tube 95 includes a first frame 44 and a second frame 45.

Figure 7A:
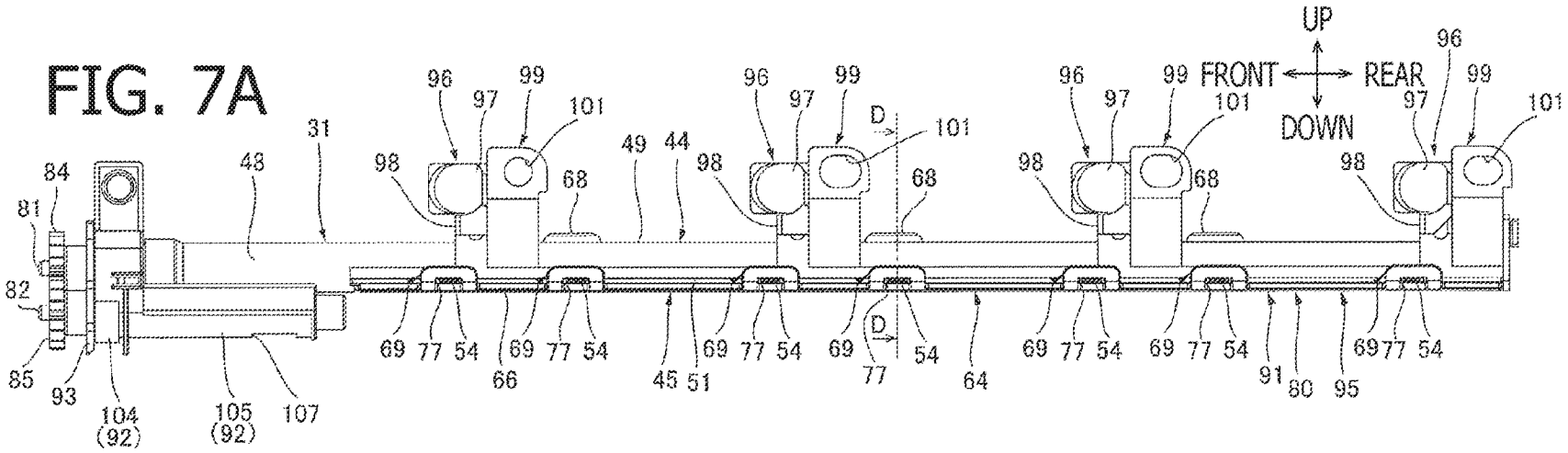
FIG. 7A is a right-side view of the transporter in the first illustrative embodiment according to one or more aspects of the present disclosure.

As shown in FIGS. 3B and 7A, the first frame 44 includes a tubular section 48, a half-tubular section 49, a first flange section 50, a second flange section 51, a plurality of first projections (in the illustrative embodiment, four first projections) 52, a plurality of second projections (in the illustrative embodiment, three second projections) 53, and a plurality of third projections (in the illustrative embodiment, seven third projections) 54.

Figure 7B:
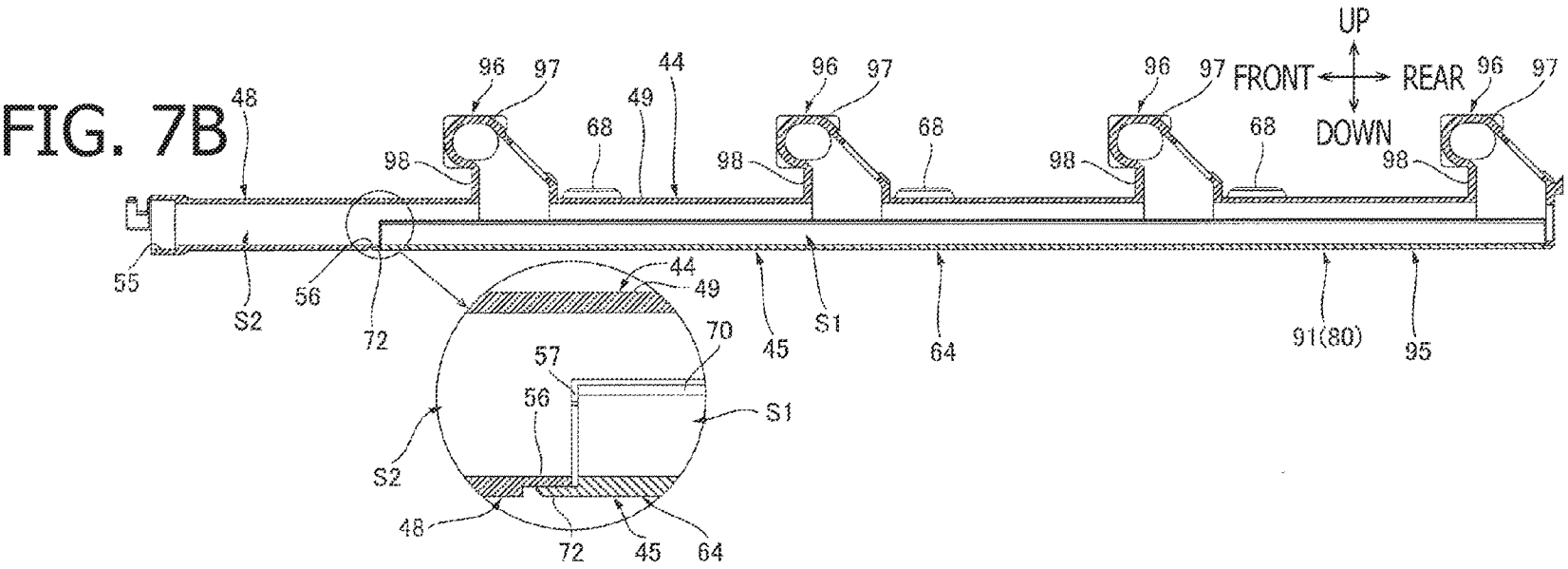
FIG. 7B is a cross-sectional right-side view of a first transportation tube in the first illustrative embodiment according to one or more aspects of the present disclosure.

The tubular section 48 is disposed at a front end portion of the first frame 44. The tubular section 48 is formed substantially in a cylindrical shape extending along the front-to-rear direction. As shown in FIG. 7B, a front end portion of the tubular section 48 is demarcated as a communication port 55. The communication port 55 may be an example of an exhaust port. The tubular section 48 includes a protrusion 56.

The protrusion 56 extends rearward from a rear end portion of a lower half of the tubular section 48. The protrusion 56 has a center axis in common with the tubular section 48, and is formed substantially in a semi-cylindrical shape having an open upper side. Namely, the protrusion 56 is disposed at an upstream end portion of the tubular section 48 in a transportation direction. The transportation direction is a direction in which toner is transported through the first transportation tube 95. The protrusion 56 protrudes in a direction opposite to the transportation direction. An inner diameter of the protrusion 56 is substantially the same as an inner diameter of the tubular section 48. An outer diameter of the protrusion 56 is slightly smaller than an outer diameter of the tubular section 48.

The half-tubular section 49 is formed substantially in a semi-cylindrical shape extending rearward from a rear end portion of an upper half of the tubular section 48. The half-tubular section 49 has a center axis in common with the tubular section 48. As shown in FIG. 6, a dimension of the half-tubular section 49 in the front-to-rear direction is substantially the same as a dimension from a center axis of the forefront photoconductive drum 11 to a rear end portion of the belt unit 5. As shown in FIGS. 3B and 9B, the half-tubular section 49 includes a first end rim 57 and a second end rim 58. Each of the first end rim 57 and the second end rim 58 is an example of a first rim. The half-tubular section 49 is an example of a first half-tubular section.

The first end rim 57 protrudes downward from a lower left end portion of the half-tubular section 49. The first end rim 57 is formed substantially in a rod shape extending over an entire length of the half-tubular section 49 in the front-to-rear direction. Further, as shown in FIG. 9B, the first end rim 57 is formed substantially in a trapezoidal shape tapered downward, in a cross-sectional front view. A right surface of the first end rim 57 is configured as an inner surface 57A.

As shown in FIGS. 3B and 9B, the second end rim 58 protrudes downward from a lower right end portion of the half-tubular section 49. The second end rim 58 is formed substantially in a rod shape extending over an entire length of the half-tubular section 49 in the front-to-rear direction. Further, as shown in FIG. 9B, the second end rim 58 is formed substantially in a trapezoidal shape tapered downward, in a cross-sectional front view. A left surface of the second end rim 58 is configured as an inner surface 58A.

As shown in FIGS. 3B and 9B, the first flange section 50 is disposed at a lower left end portion of the half-tubular section 49. The first flange section 50 protrudes leftward from a left surface of the first end rim 57, above a lower end portion of the first end rim 57. The first flange section 50 is formed substantially in a rod shape extending over an entire length of the half-tubular section 49 in the front-to-rear direction.

The second flange section 51 is disposed at a lower right end portion of the half-tubular section 49. As shown in FIG. 9B, the second flange section 51 protrudes leftward from a right surface of the second end rim 58, above a lower end portion of the second end rim 58. The second flange section 51 is formed substantially in a rod shape extending over an entire length of the half-tubular section 49 in the front-to-rear direction.

As shown in FIG. 3B, the four first projections 52 are arranged at intervals in the front-to-rear direction, at a left portion of the first frame 44. Each first projection 52 protrudes leftward from a left circumferential wall of the half-tubular section 49. A lower end portion of the half-tubular section 49 is continuous with an upper surface of the first flange section 50. A lower surface of each first projection 52 is inclined upward in a leftward direction. Each first projection 52 is configured as examples of a projection, a first engagement section, and a third engagement section.

The three second projections 53 are arranged at intervals in the front-to-rear direction, at the left portion of the first frame 44. Each second projection 53 is disposed between two first projections 52 adjacent thereto in the front-to-rear direction. As shown in FIGS. 3B and 9B, each second projection 53 protrudes leftward from the left circumferential wall of the half-tubular section 49. A lower surface of each second projection 52 is inclined upward in a leftward direction. As shown in FIG. 3B, a dimension of each second projection 53 in the front-to-rear direction is larger than a dimension of each first projection 52 in the front-to-rear direction. Each second projection 53 is configured as examples of the projection, the first engagement section, and a fourth engagement section.

Figure 9A:
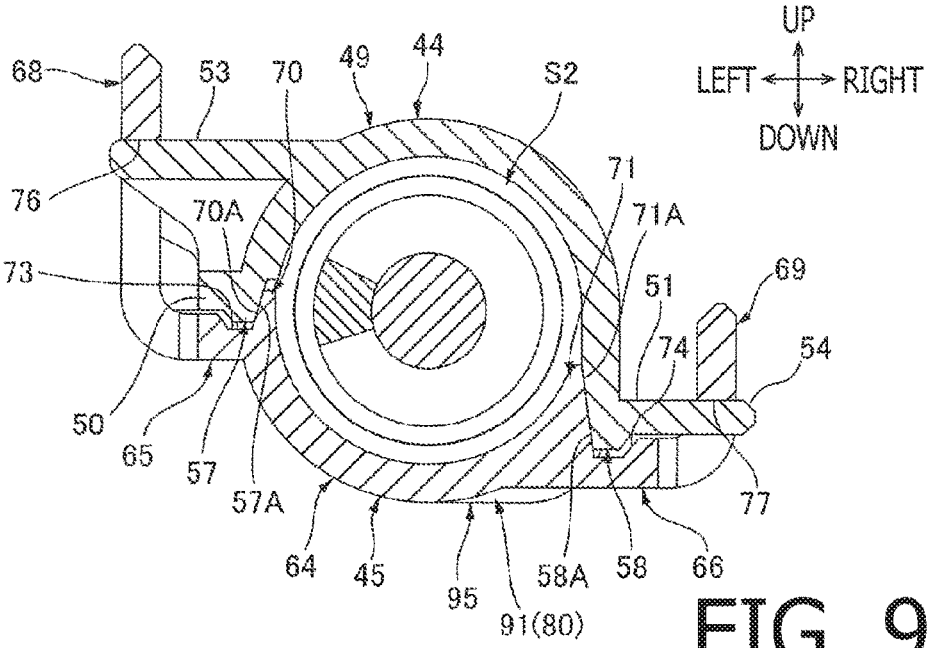
FIG. 9A is a cross-sectional view taken along line D-D shown in FIG. 7A, in the first illustrative embodiment according to one or more aspects of the present disclosure.
Figure 9B:
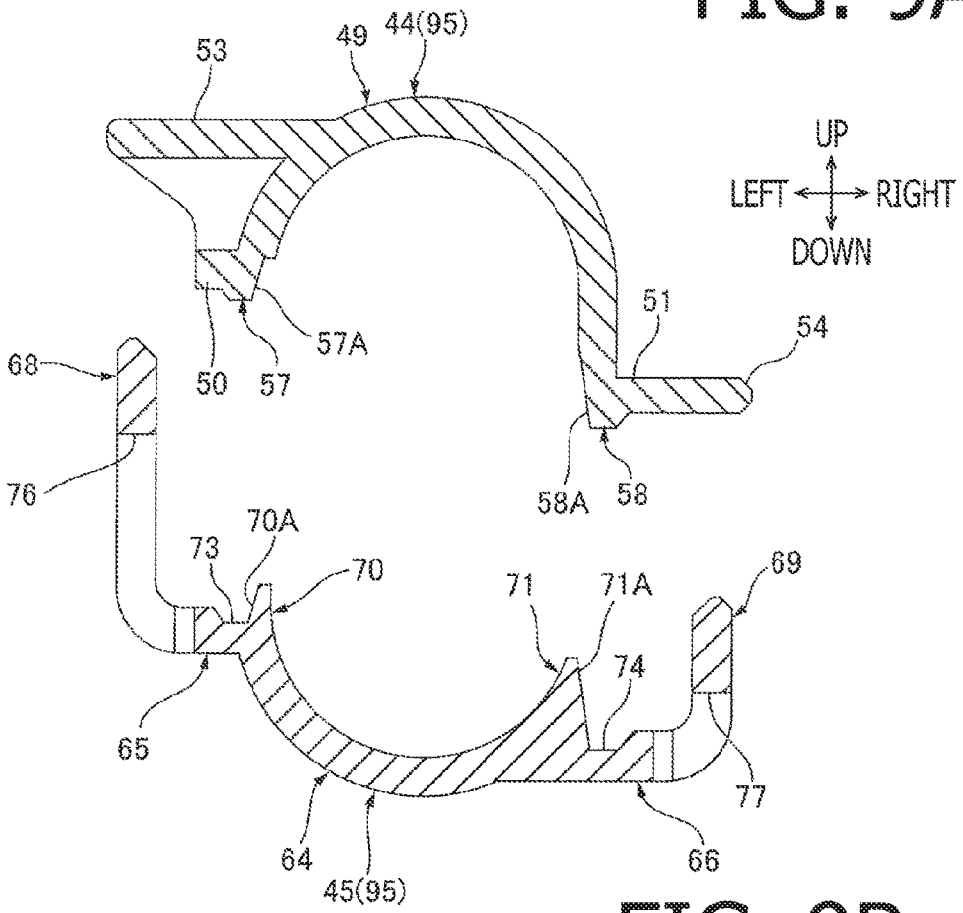
FIG. 9B is a cross-sectional front view showing the first transportation tube separated into a first frame and a second frame, in the first illustrative embodiment according to one or more aspects of the present disclosure.

As shown in FIGS. 7A and 9A, the seven third projections 54 are arranged at intervals in the front-to-rear direction, at a right portion of the first frame 44. Each third projection 54 protrudes rightward from a right end portion of the second flange section 51. Each third projection 54 is formed substantially in a rectangular flat plate shape in a plane view (i.e., when viewed from the top). Each third projection 54 is configured as examples of the projection and the first engagement section.

As shown in FIGS. 3B and 7A, the second frame 45 is disposed below a lower portion of the half-tubular section 49 of the first frame 44. As shown in FIGS. 3B and 9B, the second frame 45 includes a half-tubular section 64, a third flange section 65, a fourth flange section 66, a plurality of first hook sections (in the illustrative embodiment, four first hook sections) 67, a plurality of second hook sections (in the illustrative embodiment, three second hook sections) 68, and a plurality of third hook sections (in the illustrative embodiment, seven third hook sections) 69. The third flange section 65 includes a first recessed section 73 as an example of a recessed section. The fourth flange section 66 includes a second recessed section 74 as an example of the recessed section. Each first hook section 67 includes a first locking hole 75. Each second hook section 68 includes a second locking hole 76. Each third hook section 69 includes a third locking hole 77.

The half-tubular section 64 is formed substantially in a semi-cylindrical shape having an open upper side. The half-tubular section 64 has a center axis in common with the tubular section 48 and the half-tubular section 49 of the first frame 44. As shown in FIG. 3B, the half-tubular section 64 includes a third end rim 70, a fourth end rim 71, and a contact section 72. Each of the third end rim 70 and the fourth end rim 71 is an example of a second rim. The half-tubular section 64 is an example of a second half-tubular section.

As shown in FIGS. 3B and 9B, the third end rim 70 protrudes upward from an upper left end portion of the half-tubular section 64. The third end rim 70 is formed substantially in a rod shape extending over an entire length of the half-tubular section 64 in the front-to-rear direction. Further, the third end rim 70 is formed substantially in a trapezoidal shape having a left surface inclined rightward in an upward direction, in a cross-sectional front view. A right surface of the third end rim 70 is configured as an outer surface 70A that is an example of a contact surface. As shown in FIG. 9A, the outer surface 70A is in contact with the inner surface 57A of the first end rim 57 of the half-tubular section 49.

As shown in FIG. 9B, the fourth end rim 71 is disposed at an upper right end portion of the half-tubular section 64. The fourth end rim 71 protrudes upward from the upper right end portion of the half-tubular section 64, and is formed substantially in a rod shape extending over an entire length of the half-tubular section 64 in the front-to-rear direction. Further, the fourth end rim 71 is formed substantially in a trapezoidal shape tapered upward, in a cross-sectional front view. A left surface of the fourth end rim 71 is configured as an outer surface 71A that is an example of the contact surface. As shown in FIG. 9A, the outer surface 71A is in contact with the inner surface 58A of the second end rim 58 of the half-tubular section 49.

As shown in FIGS. 3B and 7B, the contact section 72 is a front end portion of the half-tubular section 64. The contact section 72 extends along the front-to-rear direction, and is formed substantially in a semi-cylindrical shape having an open upper side. The contact section 72 has a center axis in common with the half-tubular section 64. An outer diameter of the contact section 72 is substantially the same as an outer diameter of the half-tubular section 64. An inner diameter of the contact section 72 is slightly larger than an inner diameter of the half-tubular section 64. The contact section 72 contacts, from underneath, the protrusion 56 of the tubular section 48 of the first frame 44.

As shown in FIGS. 3B and 9B, the third flange section 65 is disposed at an upper left end portion of the half-tubular section 64. The third flange section 65 protrudes leftward from a left surface of the third end rim 70, below an upper end portion of the third end rim 70. The third flange section 65 is formed substantially in a rod shape extending over an entire length of the second frame 45 in the front-to-rear direction.

As shown in FIG. 9B, the first recessed section 73 is continuous with a lower end portion of the outer surface 70A, and is recessed downward from an upper surface of the third flange section 65. The first recessed section 73 extends over an entire length of the third flange section 65 in the front-to-rear direction. As shown in FIG. 9A, the first recessed section 73 is formed to accept the first end rim 57 of the half-tubular section 49 of the first frame 44.

As shown in FIGS. 3B and 9B, the fourth flange section 66 is disposed at a right end portion of the half-tubular section 64. The fourth flange section 66 protrudes rightward from a right surface of the fourth end rim 71, below an upper end portion of the fourth end rim 71. The fourth flange section 66 is formed substantially in a rod shape extending over an entire length of the second frame 45 in the front-to-rear direction.

As shown in FIG. 9B, the second recessed section 74 is continuous with a lower end of the outer surface 71A, and is recessed downward from an upper surface of the fourth flange section 66. The second recessed section 74 extends over an entire length of the fourth flange section 66 in the front-to-rear direction. As shown in FIG. 9A, the second recessed section 74 is formed to accept the second end rim 58 of the half-tubular section 49 of the first frame 44.

As shown in FIG. 3B, the four first hook sections 67 are arranged at intervals in the front-to-rear direction, at a left portion of the second frame 45. The four first hook sections 67 correspond to the four first projections 52, respectively. Each first hook section 67 is formed substantially in an L-shaped flat plate extending leftward from a left surface of the third flange section 65 and then bending upward, in a cross-sectional front view.

Each first locking hole 75 is substantially positioned from a middle portion to a lower end portion of the corresponding first hook section 67 in a side view (i.e., when viewed along the left-to-right direction). Each first locking hole 75 penetrates the first hook section 67 in the left-to-right direction. Each first locking hole 75 is formed substantially in a rectangular shape in a side view. As shown in FIG. 3A, each first locking hole 75 is configured to accept the corresponding first projection 52. In other words, each first projection 52 is inserted into the corresponding locking hole 75. Thereby, each first hook section 67 engages with the corresponding first projection 52 so as to contact an upper surface of the first projection 52.

As shown in FIG. 3B, the three second hook sections 68 are arranged at intervals in the front-to-rear direction, at a left portion of the second frame 45. The three second hook sections 68 correspond to the three second projections 53 of the first frame 44, respectively. Each second hook section 68 is disposed between two first hook sections 67 adjacent thereto in the front-to-rear direction. Each second hook section 68 is formed substantially in an L-shaped flat plate extending leftward from the left surface of the third flange section 65 and then bending upward, in a cross-sectional front view. A dimension of each second hook section 68 in the front-to-rear direction is larger than a dimension of each first hook section 67 in the front-to-rear direction.

Each second locking hole 76 is substantially positioned from a middle portion to a lower end portion of the corresponding second hook section 68 in a side view (i.e., when viewed along the left-to-right direction). Each second locking hole 76 penetrates the second hook section 68 in the left-to-right direction. Each second locking hole 76 is formed substantially in a rectangular shape in a side view. As shown in FIGS. 3A and 9A, each second locking hole 76 is configured to accept the corresponding second projection 53. In other words, each second projection 53 is inserted into the corresponding locking hole 76. Thereby, each second hook section 68 engages with the corresponding second projection 53 so as to contact an upper surface of the second projection 53.

As shown in FIGS. 7A and 9B, the seven third hook sections 69 are arranged at intervals in the front-to-rear direction, at a right portion of the second frame 45. The seven third hook sections 69 correspond to the seven third projections 54 of the second frame 45, respectively. Each third hook section 69 is formed substantially in an L-shaped flat plate extending rightward from the right surface of the fourth flange section 66 and then bending upward, in a cross-sectional front view.

Each third locking hole 77 is substantially positioned from a middle portion to a lower end portion of the corresponding third hook section 69 in a side view (i.e., when viewed along the left-to-right direction). Each third locking hole 77 penetrates the third hook section 69 in the left-to-right direction. Each third locking hole 77 is formed substantially in a rectangular shape in a side view. As shown in FIGS. 7A and 9A, each third locking hole 77 is configured to accept the corresponding third projection 5. In other words, each third projection 54 is inserted into the corresponding locking hole 77. Thereby, each third hook section 69 engages with the corresponding second projection 54 so as to contact an upper surface of the third projection 54.

The first hook sections 67, the second hook sections 68, and the third hook sections 69 are configured as examples of a second engagement section.

Thus, the first transportation tube 95 is formed by the first frame 44 and the second frame 45.

The half-tubular section 49 of the first frame 44 and the half-tubular section 64 of the second frame 45 form (i.e., define) a hollow first space S1 inside the first transportation tube 95.

The tubular section 48 of the first frame 44 forms (i.e., defines) a hollow second space S2 inside the first transportation tube 95.

As shown in FIGS. 3A and 7A, the four joints 96 are arranged at intervals in the front-to-rear direction, above the half-tubular section 49 of the first frame 44 of the first transportation tube 95. More specifically, as shown in FIGS. 3A and 3B, each joint 96 is disposed between an adjacent first projection 52 and an adjacent second projection 53 in the front-to-rear direction. It is noted that the rearmost joint 96 is not disposed between a first projection 52 and a second projection 53, but is disposed behind the rearmost first projection 52. Each joint 96 is configured to connect with the corresponding cleaner 30. As shown in FIGS. 3A and 7A, each joint 96 includes an insertion section 97, a communication section 98, and a fixing section 99. The fixing section 99 has a fixing hole 101.

Each insertion section 97 is disposed at an upper front end portion of the corresponding joint 96. Each insertion section 97 is formed substantially in a cylindrical shape that extends along the left-to-right direction and has an open left end portion and a closed right end portion. Each insertion section 97 is connected with a right end portion of the frame 60 of the corresponding cleaner 30 via a seal member (not shown). A right end portion of the cleaning transportation member 62 of each cleaner 30 is inserted into the corresponding insertion section 97.

As shown in FIGS. 6 and 7B, each communication section 98 is positioned on a lower rear side relative to the corresponding insertion section 97. Each communication section 98 is formed substantially in a rectangular tubular shape extending along the vertical direction. An upper rear end portion of each communication section 98 is inclined forward in an upward direction. An upper front end portion of each communication section 98 communicates with a lower rear end portion of the corresponding insertion section 97. A lower end portion of each communication section 98 communicates with an upper end portion of the first transportation tube 95.

As shown in FIGS. 3A and 7A, each fixing section 99 is positioned at an upper rear end portion of the corresponding joint 96. Each fixing section 99 is formed substantially in a rectangular flat plate shape extending upward from a right end portion of the corresponding communication section 98, in a side view (i.e., when viewed along the left-to-right direction).

Each fixing hole 101 is positioned at a central portion of the corresponding fixing section 99. Each fixing hole 101 penetrates the corresponding fixing section 99 in the left-to-right direction. Each fixing hole 101 is formed substantially in a round shape in a side view (i.e., when viewed along the left-to-right direction).

Although the following features are not shown in any drawings, each fixing section 99 is positioned between a right end portion of the frame 60 of the corresponding cleaner 30 and the first positioning plate 28, and a screw member is screwed into the fixing hole 101. Thereby, each fixing section 99 is fixedly attached to the frame 60 of the corresponding cleaner 30 and the first positioning plate 28.

Figure 8:
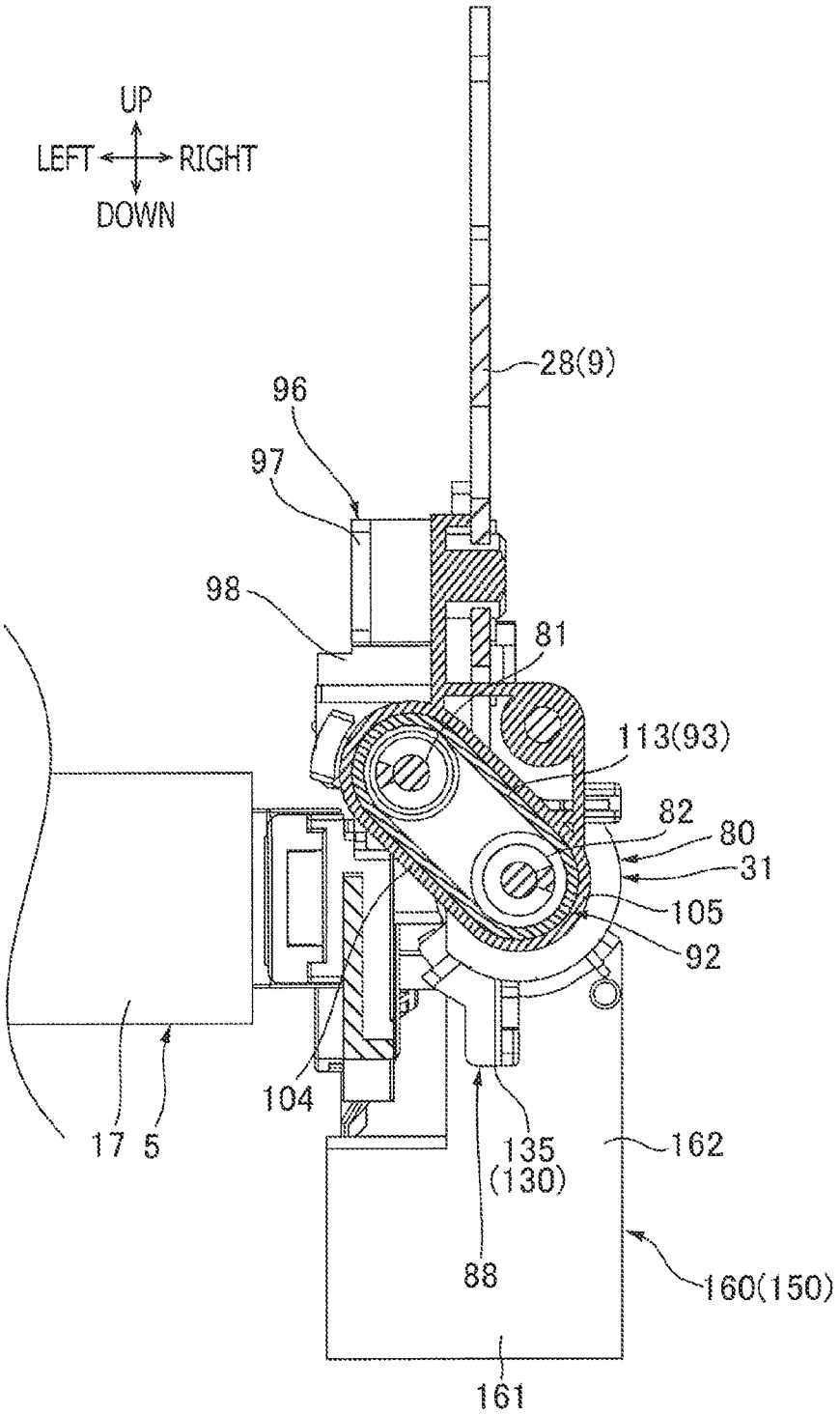
FIG. 8 is a cross-sectional view taken along line C-C shown in FIG. 6, in the first illustrative embodiment according to one or more aspects of the present disclosure.

As shown in FIGS. 6 and 8, the second transportation section 92 includes a connecting tube 103, a second transportation tube 104, and a third transportation tube 105. The third transportation tube 105 has an outlet 107. The outlet 107 is an example of the exhaust port.

The connecting tube 103 is disposed at an upper left end portion of the second transportation section 92. The connecting tube 103 is formed substantially in a cylindrical shape extending along the front-to-rear direction and having a center axis in common with the first transportation tube 95. The connecting tube 103 is fitted into the communication port 55 of the first transportation tube 95.

As shown in FIGS. 3B and 8, the second transportation tube 104 is disposed on a lower right side relative to a front end portion of the connecting tube 103. The second transportation tube 104 is formed substantially in a rectangular tubular shape extending in a direction from an upper left side to a lower right side and having an open front side. An upper left end portion of the second transportation tube 104 communicates with a lower right end part of a front end portion of the connecting tube 103.

As shown in FIGS. 3B and 6, the third transportation tube 105 is formed substantially in a cylindrical shape extending rearward from a lower right end portion of the second transportation tube 104 and having a closed rear end portion. The third transportation tube 105 extends along the same direction as the extending direction of the first transportation tube 95. The third transportation tube 105 is communicably connected with the first transportation tube 95 via the second transportation tube 104. In other words, an internal space of the first transportation tube 95 communicates with an internal space of the third transportation tube 105 via the second transportation tube 104. As shown in FIG. 6, a rear end portion of the third transportation tube 105 is positioned in front of a center axis of the forefront photoconductive drum 11 and the forefront joint 96.

As shown in FIGS. 3B and 6, the closed section 93 is disposed at a front end portion of the transportation tube 80. The closed section 93 is formed substantially in a rectangular flat plate shape extending in a direction from an upper left side to a lower right side, in a front view. The closed section 93 includes an insertion section 113.

The hole 111 is positioned substantially in a center of an upper left portion of the closed section 93. The hole 111 is formed in a round shape in a front view. The hole 111 has a center axis in common with the first transportation member 81.

The hole 112 is positioned substantially in a center of a lower right portion of the closed section 93. The hole 112 is formed in a round shape in a front view. The hole 112 has a center axis in common with the second transportation member 82.

As shown in FIG. 6, the insertion section 113 extends rearward from a rear surface of the closed section 93. As shown in FIG. 8, the insertion section 113 is formed substantially in an oval cylindrical shape in a cross-sectional front view. The insertion section 113 is fitted into a front end portion of the second transportation section 92.

As shown in FIG. 6, the first transportation member 81 is disposed inside the first transportation tube 95 of the first transportation section 91. The first transportation member 81 is an auger screw formed in the shape of a right-hand screw extending along the front-to-rear direction. A rear end portion of the first transportation member 81 is rotatably supported by a rear wall of the first transportation tube 95. A front end portion of the first transportation member 81 passes through the hole 111 of the closed section 93 and extends up to a position ahead of the closed section 93.

The second transportation member 82 is disposed inside the third transportation tube 105 of the second transportation section 95. The second transportation member 82 is an auger screw formed in the shape of a right-hand screw extending along the front-to-rear direction. The second transportation member 82 is placed in parallel with the first transportation member 81, on a lower right side relative to the first transportation member 81. A dimension of the second transportation member 82 in the front-to-rear direction is smaller than a dimension of the first transportation member 81 in the front-to-rear direction. A rear end portion of the second transportation member 82 is rotatably supported by a rear wall of the third transportation tube 105. A front end portion of the second transportation member 82 passes through the hole 112 of the closed section 93 and extends up to a position ahead of the closed section 93.

As shown in FIGS. 6 and 7A, the first gear 84 is non-rotatably supported by the front end portion of the first transportation member 81, in front of the closed section 93. The first gear 84 is formed substantially in a cylindrical shape extending along the front-to-rear direction. The first gear 84 has gear teeth throughout an outer circumferential surface thereof. Namely, the first gear 84 is fixedly attached to the first transportation member 81 and rotatable along with the first transportation member 81.

The second gear 85 is non-rotatably supported by the front end portion of the second transportation member 82, in front of the closed section 93. The second gear 85 is formed substantially in a cylindrical shape extending along the front-to-rear direction. The second gear 85 has gear teeth throughout an outer circumferential surface thereof. Namely, the second gear 85 is fixedly attached to the second transportation member 82 and rotatable along with the second transportation member 82. The second gear 85 engages with a lower right end portion of the first gear 84.

As shown in FIGS. 3B and 6, the gear cover 86 is disposed at a front end portion of the transporter 31. The gear cover 86 is formed substantially in a box shape having an open rear side and an open lower left side. The gear cover 86 covers the first gear 84 and the second gear 85 from the front such that a lower left end portion of the first gear 84 and a lower left end portion of the second gear 85 are exposed.

As shown in FIGS. 2 and 6, the shutter unit 88 is assembled with the third transportation tube 105 of the second transportation section 92. The shutter unit 88 includes a shutter 130 and an urging member 131.

The shutter 130 is rotatable between a closed position to close the outlet 107 of the third transportation tube 105 as shown in FIG. 2 and an open position to open the outlet 107 as shown in FIG. 6. The following description regarding the shutter 130 will be provided based on a state where the shutter 130 is in the closed position shown in FIG. 2.

The shutter 130 includes a shutter main body 133 and a protruding section 135. The shutter main body 133 has a communication port 134.

The shutter main body 133 is formed substantially in a cylindrical shape extending along the front-to-rear direction. The shutter main body 133 is configured to accept therein the third transportation tube 105.

The communication port 134 penetrates a right circumferential wall of the shutter main body 133 in the left-to-right direction. The communication port 134 is formed substantially in a rectangular shape in a side view (i.e., when viewed along the left-to-right direction). The communication port 134 is substantially in the same position as the outlet 107 of the third transportation tube 105 in the front-to-rear direction.

The protruding section 135 protrudes outward in a radial direction of the shutter main body 133, and is formed in an L-shape. A front end portion of the protruding section 135 is positioned in front of a front end portion of the shutter main body 133.

As shown in FIGS. 2 and 6, the urging member 131 is a coil spring formed by spirally winding a wire along the front-to-rear direction. The urging member 131 is configured to accept therein a front end portion of the third transportation tube 105. The urging member 131 overlaps the protruding section 135 of the shutter 130 in the front-to-rear direction. In other words, the urging member 131 is positionally coincident with at least a part of the protruding section 135 in the front-to-rear direction. Although the following features are not shown in any drawings, an end portion of the wire of the urging member 131 is fixedly attached to the third transportation tube 105, and the other end portion is fixedly attached to the protruding section 135. Thus, the urging member 131 is configured to urge the shutter 130 counterclockwise in a front view so as to bring the shutter 130 in the closed position.

(4) Front Plate, Rear Plate, First Side Plate, and Second Side Plate

As shown in FIGS. 2 and 4, the front plate 32 is disposed at a front end portion of the drum unit 9. The front plate 32 is formed substantially in a rectangular flat plate shape extending along the left-to-right direction as a longitudinal direction thereof, in a front view (i.e., when viewed from the front). The front plate 32 is laid between a front end portion of the first positioning plate 28 and a front end portion of the second positioning plate 29.

The rear plate 33 is disposed at a rear end portion of the drum unit 9. The rear plate 33 is formed substantially in a rectangular flat plate shape extending along the left-to-right direction as a longitudinal direction thereof, in a front view (i.e., when viewed from the front). The rear plate 33 is laid between a rear end portion of the first positioning plate 28 and a rear end portion of the second positioning plate 29.

As shown in FIGS. 2 and 4, the first side plate 34 is disposed on a right side relative to the first positioning plate 28. The first side plate 34 is formed substantially in a rectangular flat plate shape wider than the first positioning plate 28 in the vertical direction, in a side view (i.e., when viewed along the left-to-right direction).

As shown in FIG. 4, the second side plate 35 is disposed on a left side relative to the second positioning plate 29. The second side plate 35 is formed substantially in a rectangular flat plate shape wider than the second positioning plate 29 in the vertical direction, in a side view (i.e., when viewed along the left-to-right direction).

3. Configuration of Main Body Casing

As shown in FIGS. 1 and 6, the main body casing 2 includes a waste toner container 150.

As shown in FIG. 1, the waste toner container 150 is disposed below the belt unit 5. The waste toner container 150 is formed substantially in a box shape. The waste toner container 150 is configured to store therein toner removed by the cleaner 30. As shown in FIGS. 6 and 8, the waste toner container 150 includes an introduction tube 160.

The introduction tube 160 is disposed at a right end portion of a front end portion of the waste toner container 150. The introduction tube 160 includes a first section 161 and a second section 162.

As shown in FIG. 8, the first section 161 is formed substantially in a rectangular tubular shape extending along the left-to-right direction. Although the following features are not shown in any drawings, a left end portion of the first section 161 communicates with an internal space of the waste toner container 150.

As shown in FIGS. 6 and 8, the second section 162 is disposed on a right side relative to the front end portion of the belt unit 5. The second section 162 is formed substantially in a rectangular tubular shape extending along the vertical direction. A lower end portion of the second section 162 communicates with the first section 161.

4. Operations of Attaching and Detaching Drum Unit

To attach the drum unit 9 into the main body casing 2, as shown in FIG. 1, an operator first opens the opening 21 by swinging the front cover 22 of the main body casing 2 with the lower end portion of the front cover 22 as a fulcrum.

Subsequently, as shown in FIGS. 1 and 2, the operator holds the drum unit 9, places the drum unit 9 into the outside position, and pushes the drum unit 9 rearward via the opening 21.

Thereby, in the drum unit 9, the protruding section 135 of the shutter 130 comes into contact with a contact part (not shown) of the main body casing 2.

Next, when the operator further pushes the drum unit 9 rearward, the drum unit 9 is moved rearward while being guided by one or more guides (not shown), and placed into the inside position.

At this time, against the urging force from the urging member 131, the shutter 130 is placed in the open position where the communication port 134, positioned at a lower portion of the shutter main body 133, communicates with the outlet 107 of the third transportation tube 105 in the vertical direction. The outlet 107 of the third transportation tube 105 is connected with an upper end portion of the second section 162 of the introduction tube 160 of the waste toner container 150. Through the outlet 107, the transportation tube 80 communicates with the upper end portion of the second section 162 of the introduction tube 160 of the waste toner container 150.

Then, when the operator closes the front cover 22, the operation of attaching the drum unit 9 is completed.

Additionally, to move the drum unit 9 from the inside position to the outside position, the operator operates the drum unit 9 in a manner contrary to the above attaching operation.

Specifically, as shown in FIG. 1, the operator first opens the front cover 22 of the main body casing 2.

Subsequently, the operator holds the drum unit 9 and pulls the drum unit 9 frontward.

Thereby, the drum unit 9 is slightly moved toward an upper front side while being guided by one or more guides (not shown) of the main body casing 2.

Then, in response to the movement of the drum unit 9, while being urged counterclockwise by the urging member 131 in a front view (i.e., when viewed from the front side), the shutter 130 rotates counterclockwise in the front view, with the protruding section 135 separating from the contact part (not shown) of the main body casing 2.

Thus, as shown in FIG. 2, the shutter 130 moves to the closed position where the outlet 107 is closed by the circumferential wall of the shutter main body 133.

Then, the operator further pulls the drum unit 9 frontward.

Thereby, the drum unit 9 is placed into the outside position, and the operation of drawing the drum unit 9 is completed.

5. Cleaning Operation

Subsequently, an explanation will be provided of an operation of cleaning toner adhering to and remaining on the surface of each photoconductive drum 11.

As shown in FIG. 5, toner remaining on each photoconductive drum 11 in an image forming operation is scraped and removed by the cleaning member 61 of the corresponding cleaner 30 when the cleaning member 61 comes into contact with the photoconductive drum 11 in response to rotation of the photoconductive drum 11.

Then, the toner removed from the surface of the photoconductive drum 11 falls into the frame 60.

At this time, in response to one or more gears (not shown) receiving a driving force from the photoconductive drum 11, the cleaning transportation member 62 rotates clockwise in right side view (i.e., when viewed from the right).

Thereby, the toner in the frame 60 is transported rightward by the cleaning transportation member 62.

Then, as shown in FIG. 6, the toner transported rightward in each frame 60 flows into the first space S1 of the first transportation tube 95 via the insertion section 97 and the communication section 98 of the corresponding joint 96.

At this time, in response to a driving force from a driving gear (not shown) of the main body casing 2 being transmitted to the second gear 85, the second transportation member 82 is rotating counterclockwise in a front view (i.e., when viewed from the front).

Further, in response to the driving force from the driving gear (not shown) of the main body casing 2 being transmitted to the first gear 84 via the second gear 85, the first transportation member 81 rotates clockwise in a front view (i.e., when viewed from the front).

Thereby, the toner introduced into the first transportation tube 95 is transported frontward in the first space S1 by the first transportation member 81.

Thus, the toner scraped and removed from the surfaces of the four photoconductive drums 11 is collected into the first space S1 and transported frontward into the second space S2.

Then, the toner transported to a front end portion of the first transportation tube 95 flows into the connecting tube 103 of the second transportation section 92 via the communication port 55 of the first frame 44.

At this time, when transported frontward by the first transportation member 81, the toner comes into contact with the rear surface of the closed section 93, moves by its own weight toward a lower right side inside the second transportation tube 104, and flows into the front end portion of the third transportation tube 105.

Subsequently, the toner introduced into the front end portion of the third transportation tube 105 is transported rearward by the second transportation member 82.

Thereby, the toner is transported to the outlet 107 inside the third transportation tube 105, and is discharged into the introduction tube 160 via the outlet 107.

Then, the toner is stored into the waste toner container 150 via the introduction tube 160.

Through the aforementioned procedure, the operation of cleaning the toner remaining on the surface of each photoconductive drum 11 is completed.

6. Operations and Advantageous Effects

According to the image forming apparatus 1, as shown in FIGS. 5 and 6, the toner removed from the surface of each photoconductive drum 11 by the corresponding cleaner 30 is transported through the transportation tube 80 toward the waste toner container 150 by the first transportation member 81.

At this time, as shown in FIG. 6, in the transportation tube 80, the toner passes through the first space S1 defined by the half-tubular section 49 of the first frame 44 and the half-tubular section 64 of the second frame 45, and passes through the second space S2 formed in the tubular section 48 of the first frame 44.

Therefore, in an upstream portion of the transportation tube 80 in the transportation direction, the toner is transported in the first space S1 defined by the half-tubular section 49 of the first frame 44 and the half-tubular section 64 of the second frame 45. Further, in a downstream portion of the transportation tube 80 in the transportation direction in which a higher toner pressure is applied to the transportation tube 80 than in the upstream portion, the toner is transported without leaking outside, in the second space S2 formed in the tubular section 48 that is formed only by the first frame 44.

Consequently, the toner is stably transported by the first frame 44 and the second frame 45.

Further, according to the image forming apparatus 1, as shown in FIGS. 3A and 9A, it is possible to fixedly attach the second frame 45 to the first frame 44 by engaging the first hook sections 67 with the first projections 52, engaging the second hook sections 68 with the second projections 53, and engaging the third hook sections 69 with the third projections 54.

Therefore, it is possible to certainly form the first space S1 by the half-tubular section 49 of the first frame 44 and the half-tubular section 64 of the second frame 45.

Further, according to the image forming apparatus 1, as shown in FIGS. 3A and 9A, it is possible to engage the first hook sections 67 with the first projections 52 by such a simple configuration that the first locking hole 75 of each first hook section 67 accepts the corresponding first projection 52 so as to bring each first hook section 67 into contact with the upper surface of the corresponding first projection 52. In addition, it is possible to engage the second hook sections 68 with the second projections 53 by such a simple configuration that the second locking hole 76 of each second hook section 68 accepts the corresponding second projection 53 so as to bring each second hook section 68 into contact with the upper surface of the corresponding second projection 53.

Therefore, it is possible to easily form the first space S1 by the half-tubular section 49 of the first frame 44 and the half-tubular section 64 of the second frame 45.

Further, according to the image forming apparatus 1, as shown in FIG. 3B, the lower surface of each first projection 52 is inclined upward in such a direction as to become farther away from the second space S2 (i.e., in a leftward direction). Therefore, by assembling the second frame 45 with the half-tubular section 49 of the first frame 44 from underneath, it is possible to guide each first hook section 67 by the inclined portion of the corresponding first projection 52. Thus, it is possible to easily bring each first hook section 67 into contact with the upper surface of the corresponding first projection 52.

As shown in FIGS. 3B and 9A, the lower surface of each second projection 53 is inclined upward in such a direction as to become farther away from the second space S2 (i.e., in the leftward direction). Therefore, by assembling the second frame 45 with the half-tubular section 49 of the first frame 44 from beneath, it is possible to guide each second hook section 68 along the inclined portion of the corresponding second projection 53. Thus, it is possible to easily bring each second hook section 68 into contact with the upper surface of the corresponding second projection 53.

Therefore, it is possible to easily engage each first projection 52 with the corresponding first hook section 67 and easily engage each second projection 53 with the corresponding second hook section 68.

Further, according to the image forming apparatus 1, as shown in FIGS. 3A and 7A, the first frame 44 and the second frame 45 are engaged with each other in a plurality of positions. Hence, it is possible to certainly and fixedly attach the second frame 45 to the first frame 44.

Further, according to the image forming apparatus 1, as shown in FIG. 7B, in a state where the second frame 45 is fixedly attached to the first frame 44, the contact section 72 of the half-tubular section 64 of the second frame 45 is disposed below the protrusion 56 of the tubular section 48 of the first frame 44. Therefore, it is possible to prevent formation of a gap between the tubular section 48 of the first frame 44 and the half-tubular section 64 of the second frame 45 in the transportation direction.

Therefore, it is possible to prevent leakage of toner from between the tubular section 48 of the first frame 44 and the half-tubular section 64 of the second frame 45. Thus, it is possible to stably transport toner from the first space S1 to the second space S2.

Further, according to the image forming apparatus 1, as shown in FIG. 9A, the outer surface 70A of the third end rim 70 of the half-tubular section 64 of the second frame 45 is configured to contact the inner surface 57A of the first end rim 57 of the half-tubular section 49 of the first frame 44. In addition, the outer surface 71A of the fourth end rim 71 of the half-tubular section 64 of the second frame 45 is configured to contact the inner surface 58A of the second end rim 58 of the half-tubular section 49 of the first frame 44. Thereby, it is possible to prevent formation of a gap between the half-tubular section 79 of the first frame 44 and the half-tubular section 64 of the second frame 45.

Therefore, it is possible to prevent leakage of toner passing through the first space S1 that is formed by the half-tubular section 49 of the first frame 44 and the half-tubular section 64 of the second frame 45.

Further, according to the image forming apparatus 1, as shown in FIGS. 3A and 9A, the outer surface 70A of the third end rim 70 is configured to contact the inner surface 57A of the first end rim 57. In addition, the outer surface 71A of the fourth end rim 71 is configured to contact the inner surface 58A of the second end rim 58. Thereby, it is possible to secure a large contact area between the second frame 45 and the first frame 44.

Therefore, it is possible to certainly prevent formation of a gap between the half-tubular section 49 of the first frame 44 and the half-tubular section 64 of the second frame 45.

Further, according to the image forming apparatus 1, as shown in FIG. 9A, the first recessed section 73 of the second frame 45 is configured to accept the first end rim 57. In addition, the second recessed section 74 of the second frame 45 is configured to accept the second end rim 58. Thereby, it is possible to secure a large contact area between the second frame 45 and the first frame 44.

Thus, it is possible to more certainly prevent formation of a gap between the half-tubular section 49 of the first frame 44 and the half-tubular section 64 of the second frame 45.

Further, according to the image forming apparatus 1, as shown in FIGS. 9A and 9B, the first recessed section 73 is continuous with the outer surface 70A of the third end rim 70. Thereby, the inner surface 57A of the first end rim 57 is brought into contact with the outer surface 70A of the third end rim 70. Additionally, the first end rim 57 is accepted by the first recessed section 73.

Further, the second recessed section 74 is continuous with the outer surface 71A of the fourth end rim 71. Thereby, the inner surface 58A of the second end rim 58 is brought into contact with the outer surface 71A of the fourth end rim 71. Additionally, the second end rim 58 is accepted by the second recessed section 74.

Hence, it is possible to more certainly prevent formation of a gap between the half-tubular section 49 of the first frame 44 and the half-tubular section 64 of the second frame 45.

Further, according to the image forming apparatus 1, as shown in FIGS. 5 and 6, each of the cleaners 30 is connected with the first frame 44 via a corresponding one of the joints 96. Therefore, it is possible to certainly transport the toner removed from the surface of each photoconductive drum 11, to the first frame 44.

Further, according to the image forming apparatus 1, the photoconductive drums 11 and the joints 96 are positioned by the first positioning plate 28. Therefore, it is possible to improve the accuracy of the position of each photoconductive drum 11 relative to the corresponding cleaner 30.

Further, according to the image forming apparatus 1, as shown in FIGS. 3A and 3B, each first projection 52 and the corresponding second projection 53 are disposed to face each other across the corresponding joint 96 in the front-to-rear direction. Therefore, near the joints 96, it is possible to certainly prevent leakage of toner from between the half-tubular section 49 of the first frame 44 and the half-tubular section 64 of the second frame 45.

Further, according to the image forming apparatus 1, as shown in FIG. 6, after being transported through the first transportation tube 95 that includes the first frame 44 and the second frame 45, the toner is transported through the second transportation tube 104 and the third transportation tube 105 in the aforementioned order, inside the transportation tube 80. Thereafter, the toner is discharged from the outlet 107.

Therefore, it is possible to improve flexibility for toner transportation, and to more certainly transport the toner to the waste toner container 150.

Further, according to the image forming apparatus 1, as shown in FIGS. 3A and 6, the tubular section 48 is formed in a cylindrical shape. Thereby, it is possible to equalize a pressure applied to the inner surface of the tubular section 48 of the first frame 44 when the toner passes through the second space S2.

Therefore, it is possible to stably transport the toner.

Further, according to the image forming apparatus 1, as shown in FIGS. 3A and 6, each of the half-tubular section 49 of the first frame 44 and the half-tubular section 64 of the second frame 45 is formed in a semi-cylindrical shape. Thereby, it is possible to form the first space S1 having a circular cross-section, by the half-tubular section 49 of the first frame 44 and the half-tubular section 64 of the second frame 45.

Hence, it is possible to equalize a pressure applied to the inner surfaces of the half-tubular section 49 of the first frame 44 and the half-tubular section 64 of the second frame 45 when the toner passes through the first space S1.

Therefore, it is possible to more stably transport the toner.

Further, according to the image forming apparatus 1, as shown in FIGS. 3B and 6, the first transportation member 81 is an auger screw. Therefore, it is possible to more certainly transport the toner inside the transportation tube 80.

Further, according to the drum unit 9, as shown in FIGS. 5 and 6, the toner removed from the surfaces of the photoconductive drums 11 by the cleaners 30 is transported inside the transportation tube 80 by the first transportation member 81.

At this time, as shown in FIG. 6, inside the transportation tube 80, the toner passes through the first space S1 formed by the half-tubular section 49 of the first frame 44 and the half-tubular section 64 of the second frame 45, and passes through the second space S2 formed in the tubular section 48 of the first frame 44.

Therefore, in the upstream portion of the transportation tube 80 in the transportation direction, it is possible to transport the toner through the first space S1 formed by the half-tubular section 49 of the first frame 44 and the half-tubular section 64 of the second frame 45, without leaking the toner outside. Further, in the downstream portion of the transportation tube 80 in the transportation direction where a higher toner pressure is applied to the transportation tube 80 than in the upstream portion, it is possible to transport the toner through the second space S2 formed in the tubular section 48 that is formed only by the first frame 44, without leaking the toner outside.

Consequently, it is possible to stably transport the toner by the first frame 44 and the second frame 45.

7. Second Embodiment

Figure 10A:
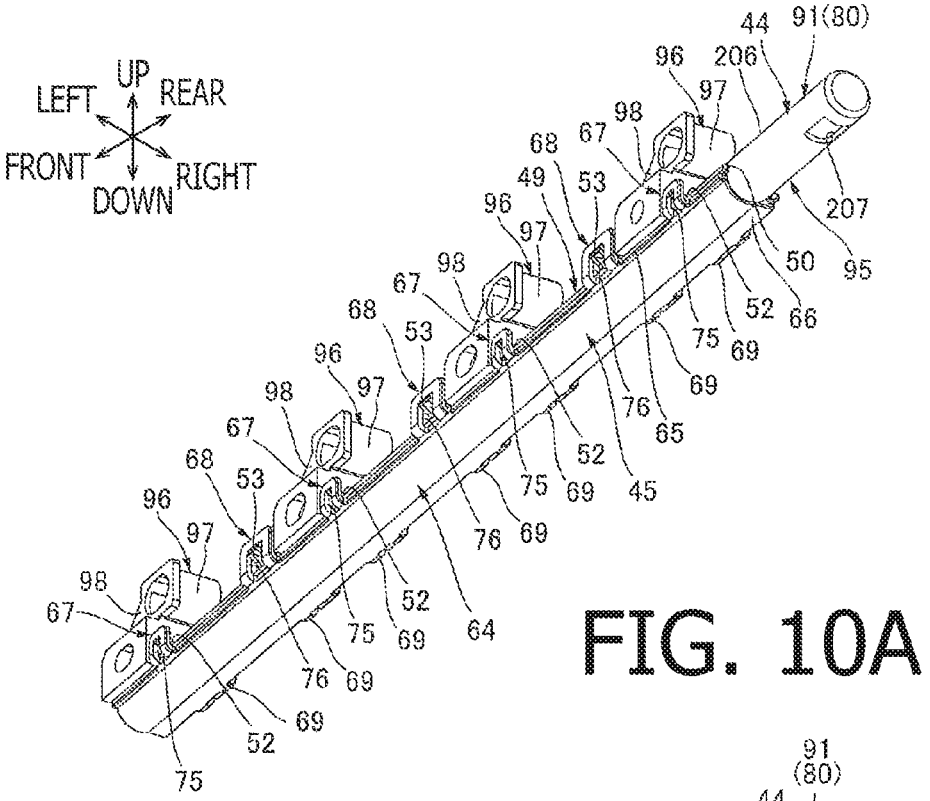
FIG. 10A is a perspective view, from a lower left side, of a transportation tube to be attached to an image forming apparatus in a second illustrative embodiment according to one or more aspects of the present disclosure.
Figure 10B:
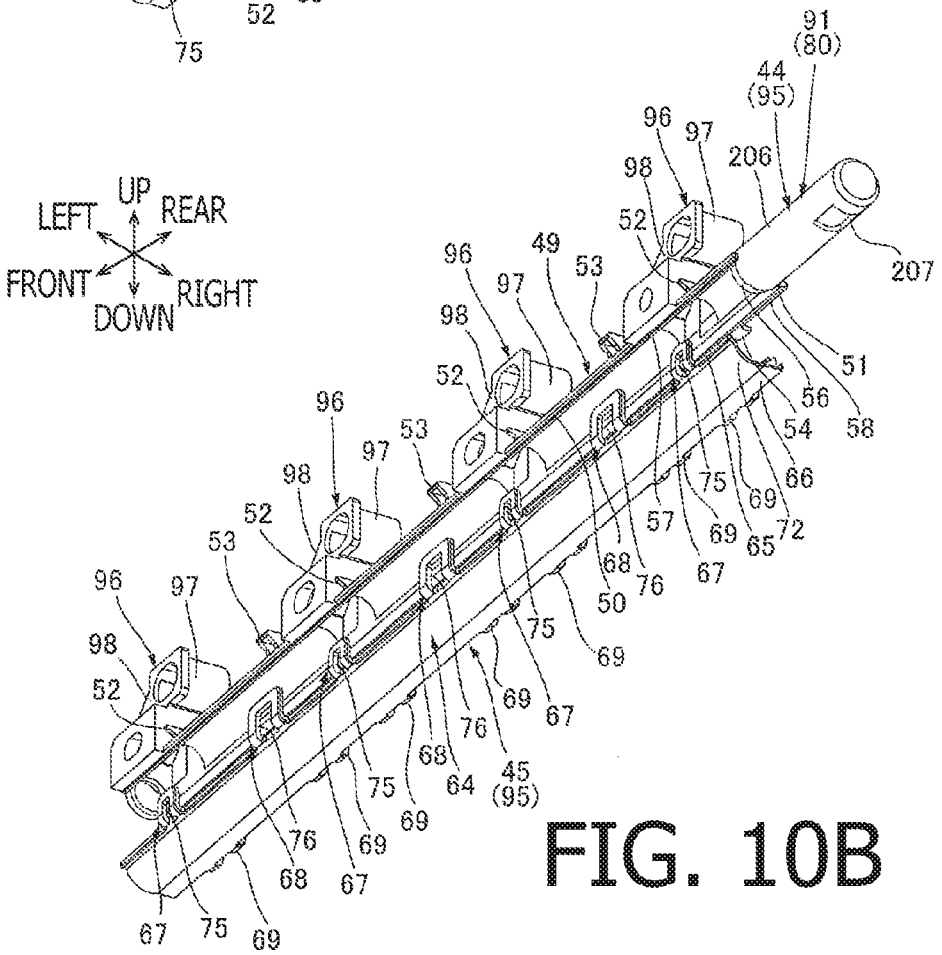
FIG. 10B is an exploded perspective view of the transportation tube in the second illustrative embodiment according to one or more aspects of the present disclosure.

Referring to FIGS. 10A and 10B, a second illustrative embodiment according to aspects of the present disclosure will be described. It is noted that, in the second illustrative embodiment, the same elements as exemplified in the first illustrative embodiment will be provided with the same reference characters, and explanations of the same elements will be omitted.

In the aforementioned first illustrative embodiment, as shown in FIG. 3B, the transportation tube 80 includes the second transportation section 92 and the closed section 93. The toner introduced into the first transportation tube 95 passes through the second transportation tube 104 and the third transportation tube 105, and is discharged into the waste toner container 150 via the outlet 107.

In contrast, in the second illustrative embodiment, the transportation tube 80 does not include the second transportation section 92 or the closed section 93. Instead, the first transportation tube 95 includes an outlet 207 for discharging the toner into the waste toner container 150. The outlet 207 is an example of the exhaust port.

Specifically, the first frame 44 of the first transportation tube 95 includes a tubular section 206 having the outlet 207.

The tubular section 206 is disposed at the front end portion of the first frame 44. The tubular section 206 is formed substantially in a cylindrical shape having a closed front end portion. The tubular section 206 forms a hollow second space S2 inside the first transportation tube 95.

The outlet 207 is disposed at a rear end portion of the tubular section 48. The outlet 207 penetrates a lower circumferential wall in the vertical direction.

Then, when the outlet 207 is connected with the waste toner container 150, the toner in the first transportation tube 95 is transported into the waste toner container 150.

According to the second illustrative embodiment, the tubular section 206 of the first frame 44 includes the outlet 207. Therefore, after passing through the first space S1 formed by the half-tubular section 49 of the first frame 44 and the half-tubular section 64 of the second frame 45, the toner is allowed to be discharged from the outlet 207 via the second space S2, in the downstream portion of the transportation tube 80 in the transportation direction in which a higher toner pressure is applied to the transportation tube 80 than in the upstream portion.

In the second illustrative embodiment as well, substantially the same effects as exemplified in the aforementioned first illustrative embodiment can be provided.

Hereinabove, the illustrative embodiments according to aspects of the present disclosure have been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

8. Modifications

In the aforementioned illustrative embodiments, the half-tubular section 49 of the first frame 44 is formed substantially in a semi-cylindrical shape. Nonetheless, the half-tubular section 49 of the first frame 44 may be formed in a partially-cylindrical shape. Further, in the aforementioned illustrative embodiments, the half-tubular section 64 of the second frame 45 is formed substantially in a semi-cylindrical shape. Nonetheless, the half-tubular section 64 of the second frame 45 may be formed in a partially-cylindrical shape.

What is claimed is:

1. An image forming apparatus comprising:
- a main body casing;
- a waste toner container; and
- a drum unit configured to move between a first position inside the main body casing and a second position outside the main body casing, the drum unit comprising:
  - a first photoconductive drum;
  - a first cleaner configured to remove toner remaining on a surface of the first photoconductive drum;
  - a second photoconductive drum, the first photoconductive drum and the second photoconductive drum being arranged in a transportation direction along a moving direction of the drum unit;
- a second cleaner configured to remove toner remaining on a surface of the second photoconductive drum; and
- a transporter configured to transport the toner removed by the first cleaner and the second cleaner toward the waste toner container, the transporter comprising:
  - a first transportation member configured to transport the toner removed by the first cleaner and the second cleaner, in the transportation direction along the moving direction of the drum unit; and
  - a transportation tube extending in the transportation direction and accommodating the first transportation member, the transportation tube having an exhaust port configured to allow the toner transported by the first transportation member to pass therethrough toward the waste toner container, the transportation tube comprising:
    - a first frame comprising a first half-tubular section and a tubular section; and
    - a second frame comprising a second half-tubular section, the first half-tubular section and the second half-tubular section being configured to define a first space as a hollow space, the first space being configured to allow the toner removed by the first cleaner and the second cleaner to pass therethrough, the tubular section of the first frame being configured to define a second space as a hollow space, the second space being configured to allow the toner passed through the first space to pass therethrough.

2. The image forming apparatus according to claim 1, wherein the tubular section of the first frame has the exhaust port.

3. The image forming apparatus according to claim 1,
- wherein the first frame comprises a first engagement section, and
- wherein the second frame comprises a second engagement section configured to engage with the first engagement section.

4. The image forming apparatus according to claim 3,
- wherein the first engagement section comprises a projection protruding when viewed along the moving direction, and
- wherein the second engagement section is configured to contact an upper surface of the projection.

5. The image forming apparatus according to claim 4, wherein the first engagement section has a lower surface inclined upward in such a direction as to become farther away from the second space.

6. The image forming apparatus according to claim 3,
- wherein a plurality of the first engagement sections are arranged at intervals in the moving direction, and
- wherein a plurality of the second engagement sections are arranged at intervals in the moving direction.

7. The image forming apparatus according to claim 1,
- wherein the tubular section of the first frame comprises a protrusion disposed at an upstream end portion of the first transportation member in the transportation direction, the protrusion protruding in an opposite direction of the transportation direction, and
- wherein the second half-tubular section of the second frame comprises a contact section disposed at a downstream end portion of the second half-tubular section in the transportation direction, the contact section being configured to protrude in the transportation direction and contact the protrusion from underneath in a state where the second frame is attached to the first frame.

8. The image forming apparatus according to claim 1, wherein the first half-tubular section of the first frame comprises a first rim, the first rim extending downward from an end portion of the first half-tubular section that is close to the second frame in a vertical direction, and wherein the second frame comprises a second rim, the second rim extending upward from an end portion of the second frame that is close to the first half-tubular section in the vertical direction, the second rim being configured to contact an inner surface of the first rim.

9. The image forming apparatus according to claim 8, wherein the second rim has a contact surface configured to contact an inner surface of the first rim.

10. The image forming apparatus according to claim 9, wherein the second frame comprises a recessed section that is recessed downward, the recessed section being configured to accept the first rim.

11. The image forming apparatus according to claim 10, wherein the recessed section is continuous with the contact surface.

12. The image forming apparatus according to claim 1, wherein the transportation tube comprises a joint configured to connect the first frame with the first cleaner and the second cleaner.

13. The image forming apparatus according to claim 12, wherein the drum unit comprises a positioning plate positioning the first photoconductive drum and the second photoconductive drum, and wherein the joint comprises a fixing section fixedly attached to the positioning plate.

14. The image forming apparatus according to claim 12, wherein the first frame comprises a first engagement section, wherein the second frame comprises a second engagement section configured to engage with the first engagement section, and wherein the first engagement section comprises:

a third engagement section positioned adjacent to the joint in the moving direction; and a fourth engagement section positioned adjacent to the joint and opposed to the third engagement section across the joint in the moving direction.

15. The image forming apparatus according to claim 12, wherein the transportation tube comprises:

a first transportation tube extending along the moving direction, the first transportation tube accommodating the first transportation member, the first transportation tube comprising the first frame and the second frame;

a second transportation tube connecting with the first transportation tube, the second transportation tube extending along a direction intersecting the moving direction along which the first transportation tube extends; and a third transportation tube connecting with the second transportation tube, the third transportation tube having the exhaust port, the third transportation tube extending along the moving direction along which the first transportation tube extends.

16. The image forming apparatus according to claim 1, wherein the tubular section is formed in a cylindrical shape.

17. The image forming apparatus according to claim 1, wherein the first half-tubular section of the first frame is formed in a semi-cylindrical shape, and wherein the second half-tubular section of the second frame is formed in a semi-cylindrical shape.

18. The image forming apparatus according to claim 1, wherein the first transportation member comprises an auger screw.

19. The image forming apparatus according to claim 15, wherein the third transportation tube accommodates a second transportation member, the second transportation member being configured to transport the toner passed through the first transportation tube and the second transportation tube, toward the exhaust port.

20. A drum unit comprising:

a first photoconductive drum;

a first cleaner configured to remove toner remaining on a surface of the first photoconductive drum;

a second photoconductive drum, the first photoconductive drum and the second photoconductive drum being arranged in a transportation direction along a moving direction of the drum unit;

a second cleaner configured to remove toner remaining on a surface of the second photoconductive drum; and a transporter configured to transport the toner removed by the first cleaner and the second cleaner, the transporter comprising:

a transportation member configured to transport the toner removed by the first cleaner and the second cleaner in the transportation direction along the moving direction of the drum unit; and a transportation tube extending in the transportation direction and accommodating the transportation member, the transportation tube having an exhaust port configured to allow the toner transported by the transportation member to pass therethrough, the transportation tube comprising:

a first frame comprising a first half-tubular section and a tubular section; and a second frame comprising a second half-tubular section, the first half-tubular section and the second half-tubular section being configured to define a first space as a hollow space, the first space being configured to allow the toner removed by the first cleaner and the second cleaner to pass therethrough, the tubular section of the first frame being configured to define a second space as a hollow space, the second space being configured to allow the toner passed through the first space to pass therethrough.

* * * * *